US008104980B2

(12) United States Patent
Murata

(10) Patent No.: US 8,104,980 B2
(45) Date of Patent: Jan. 31, 2012

(54) TAPE PRINTER AND CASSETTE

(75) Inventor: Susumu Murata, Toyoake (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 539 days.

(21) Appl. No.: 12/319,388

(22) Filed: Jan. 7, 2009

(65) Prior Publication Data

US 2009/0196669 A1 Aug. 6, 2009

(30) Foreign Application Priority Data

Jan. 31, 2008 (JP) ..... 2008-020750

(51) Int. Cl.
*B41J 11/00* (2006.01)

(52) U.S. Cl. ..... 400/613

(58) Field of Classification Search ..... 400/613, 400/615.2, 619, 207, 208
See application file for complete search history.

(56) References Cited

U.S. PATENT DOCUMENTS 6,017,159 A * 1/2000 Tse ..... 400/208
6,332,725 B1 * 12/2001 Palmer et al. ..... 400/615.2
6,930,697 B2 8/2005 Tanaka
7,686,527 B2 * 3/2010 Harada et al. ..... 400/621
2006/0216100 A1 * 9/2006 Minoya et al. ..... 400/619

FOREIGN PATENT DOCUMENTS

| | | |
|---|---|---|
| EP | 1 674 273 A | 6/2006 |
| JP | 01291974 | 11/1989 |
| JP | 05-104840 | 4/1993 |
| JP | 11-078188 | 3/1999 |
| JP | 11-263056 | 9/1999 |
| JP | 11-268366 | 10/1999 |
| JP | 2000-006504 | 1/2000 |
| JP | 2004195894 | 7/2004 |
| JP | 2005-288858 | 10/2005 |
| JP | 2006103337 | 4/2006 |
| WO | WO 98/16393 A | 4/1998 |

* cited by examiner

*Primary Examiner* — Seung Lee
(74) *Attorney, Agent, or Firm* — Day Pitney LLP

(57) ABSTRACT

A projection is provided in a roller holder. Accordingly, in a state wherein the roller holder is pressed against a supporting board to make a platen roller come in close contact with a thermal head, a cassette presses the roller holder through the projection in a process of loading the cassette inside a cassette loading portion. As a result, the roller holder moves in a biasing direction (direction from inward to outward of the cassette loading portion), causing the roller holder to move away from the supporting board. Thus, even if a state is maintained wherein the platen roller adhered to the thermal head and the roller holder is kept pressed against the supporting board, the roller holder can be separated from the supporting board when the cassette is loaded up.

20 Claims, 43 Drawing Sheets

TAPE PRINTER AND CASSETTE

CROSS-REFERENCE TO RELATED APPLICATIONS

The present application claims priority from Japanese Patent Application No. 2008-020750 filed on Jan. 31, 2008, the disclosure of which is herein incorporated herein by reference in its entirety.

TECHNICAL FIELD

The disclosure relates to a tape printer and a cassette wherein a pressing member which has adhered to a supporting member can be separated from the supporting member at the time of loading the cassette in the tape printer.

BACKGROUND

In conventional tape printers, printing is carried out by causing a tape-like film which is drawn from a cassette to come in close contact with a printing head. The tape-like film is brought in close contact with the printing head by interposing the film between the printing head and a platen roller (refer to Japanese Patent Application Laid-open No. 2004-195894).

To obtain this condition, the platen roller is pressed against the printing head, or conversely, the printing head is pressed against the platen roller, with the tape-like film being held thereinbetween.

With respect to the printing head and the platen roller, the pressing side is provided with a pressing member, while the pressed side is provided with a supporting member.

However, in a storing state wherein the cassette is not loaded in the tape printer, the printing head and the platen roller may be pressed against each other. In this case, the printing head and the platen roller are directly pressed against each other, without the tape-like film being held thereinbetween.

Thus, the printing head and the platen roller may adhere to each other when the tape printer is in a storing state under high temperature for an extended period of time ongoingly. In products in a standby condition for shipping, a sheet or the like is interposed between the printing head and the platen roller. As a result, the printing head and the platen roller in such products will not come in direct contact with each other, even if pressed against each other.

Alternatively, when in the hands of a user, the user cannot be expected to pay attention to the storing temperature conditions. Also, although a user might not intend to neglect the product, the product often ends up being ongoingly neglected for extended periods of time. In such a case, a user cannot be expected to interpose a sheet or the like between the printing head and the platen roller.

SUMMARY

Accordingly, the present disclosure has been made in light of the above, and it is an object of the present disclosure is to provide a tape printer and a cassette wherein a pressing member and a supporting member can be separated at the time of loading the cassette, even if the pressing member and the supporting member have adhered to each other.

To achieve the object of the present disclosure, there is provided a tape printer including: a main body; a cassette loading portion provided in the main body; a pressing member that is rotatably supported on the main body while being biased from inward to outward of the cassette loading portion; and a supporting member provided in the cassette loading portion; wherein the pressing member is pressed against the supporting member by causing the supporting member to move in an anti-biasing direction; the tape printer further comprising: a projection provided in the pressing member; wherein the pressing member is moved in a biasing direction to be moved away from the supporting member as a result of a cassette pressing the projection provided in the pressing member against the pressing member and the supporting member which are in close contact with each other, in a process of loading the cassette inside the cassette loading portion.

Furthermore, according to another aspect, there is provided a cassette for use in a tape printer, the tape printer including: a main body; a cassette loading portion provided in the main body; a pressing member that is rotatably supported on the main body while being biased from inward to outward of the cassette loading portion; and a supporting member provided in the cassette loading portion; wherein the pressing member is pressed against the supporting member by causing the pressing member to move in an anti-biasing direction; wherein when set in the cassette loading portion of the main body, the cassette includes: a bottom wall that faces a bottom face of the cassette loading portion; a side wall that is continued from the bottom wall and faces the pressing member; and a cassette case that has a projection which is provided at a contact portion between the bottom wall and the side wall and extends towards the pressing member; wherein the pressing member is moved in a biasing direction to be moved away from the supporting member as a result of the projection in the cassette pressing the pressing member against the pressing member and the supporting member which are in close contact with each other, in a process of loading the cassette inside the cassette loading portion.

DETAILED DESCRIPTION

1. Outline of a First Embodiment

Figure 2:
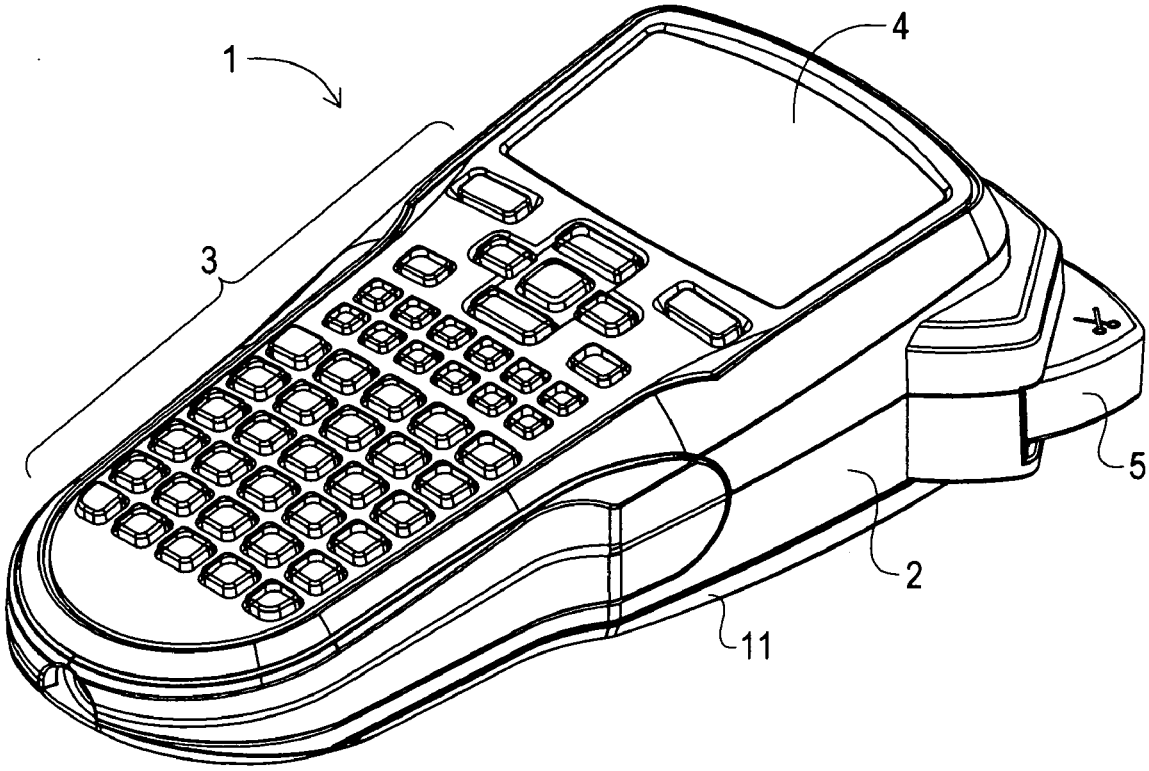
FIG. 2 is a perspective view showing an outer appearance of the tape printer, as seen from a front side of the tape printer.
Figure 3:
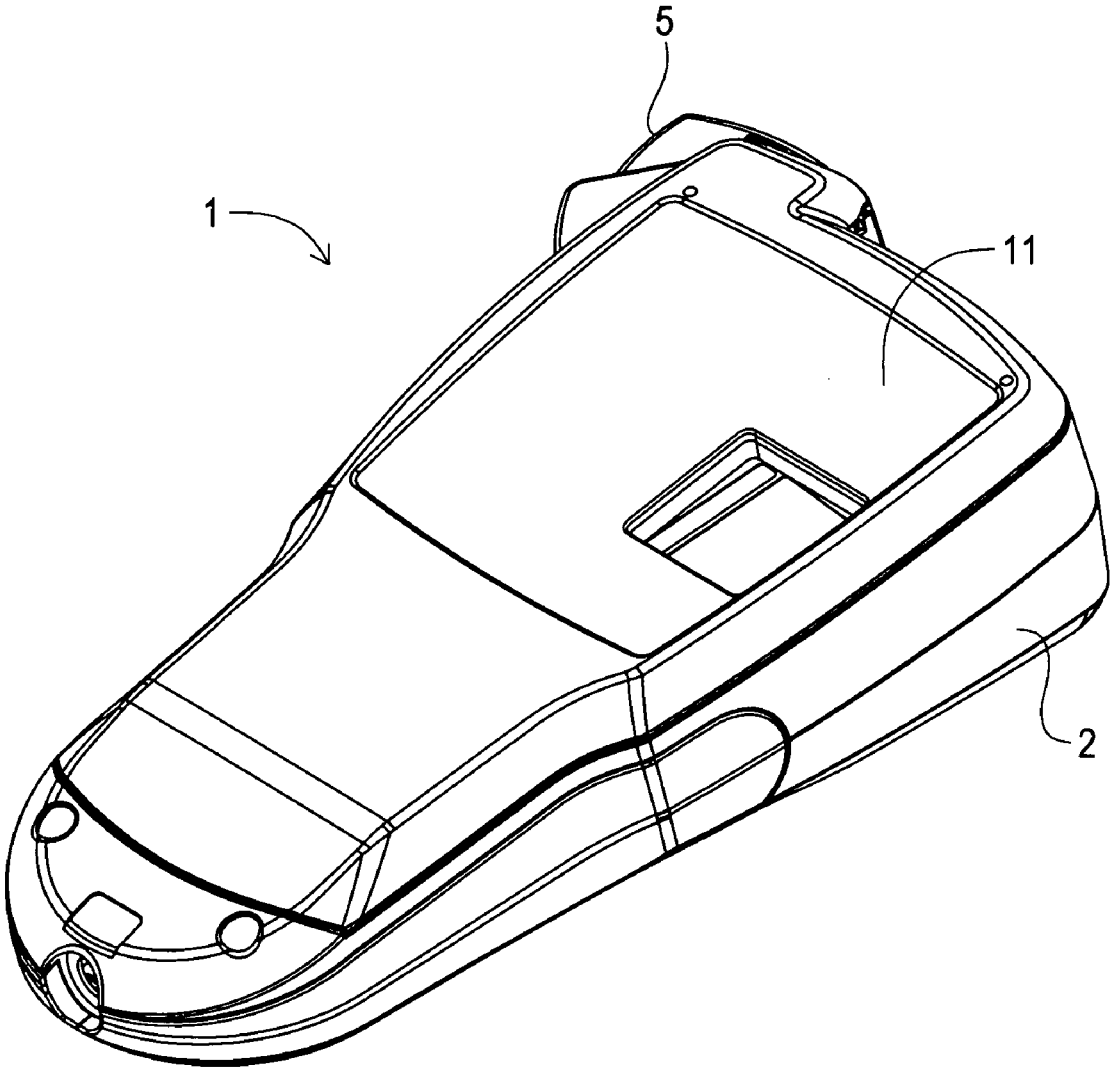
FIG. 3 is a perspective view showing an outer appearance of the tape printer, as seen from a back side of the tape printer.

A detailed description of an exemplary embodiment of (e.g., a tape printer and a cassette) of the disclosure will now be given referring to the accompanying drawings. As shown in FIG. 2 and FIG. 3, the tape printer 1 according to the first embodiment has a main body 2 wherein a key operation portion 3 made up of a plurality of keys, a display 4 and a cutting lever 5 are provided. Further, in the tape printer 1 according to the first embodiment, a cover 11 is attached with respect to the main body 2.

Figure 4:
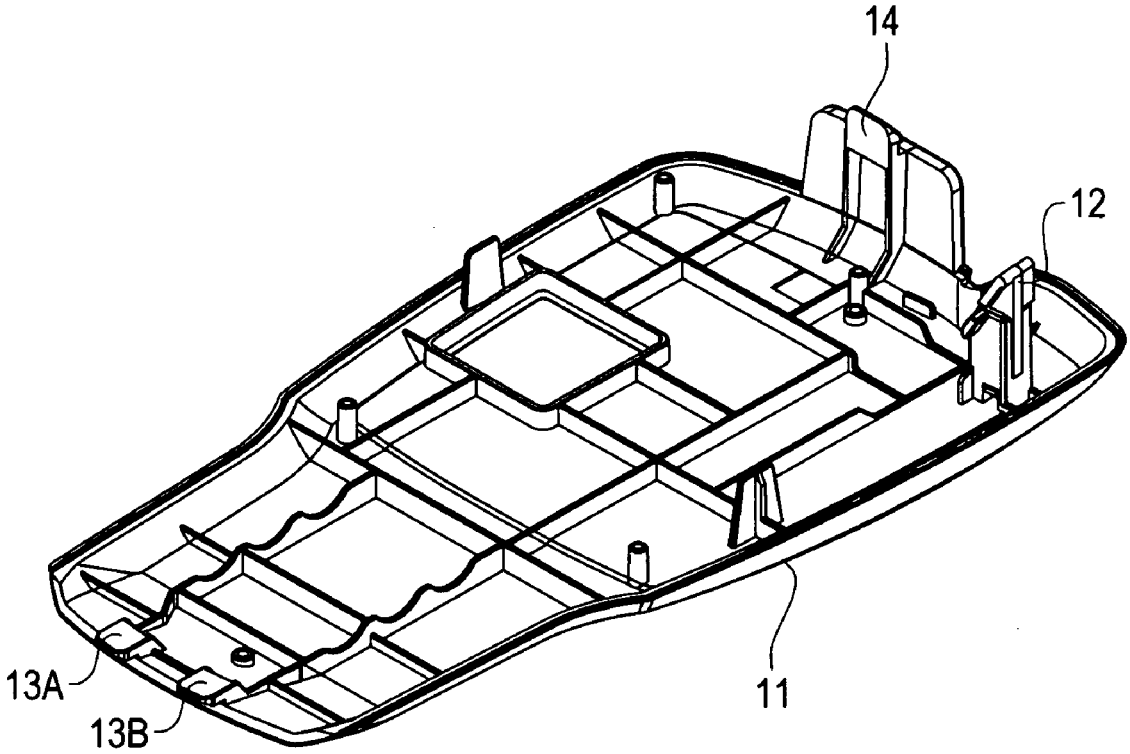
FIG. 4 is a perspective view showing an outer appearance of a rear side of a cover.

As shown in FIG. 4, the cover 11 has a protruding portion 12, a pair of first engaging claws 13A and 13B and a second engaging claw 14.

Figure 5:
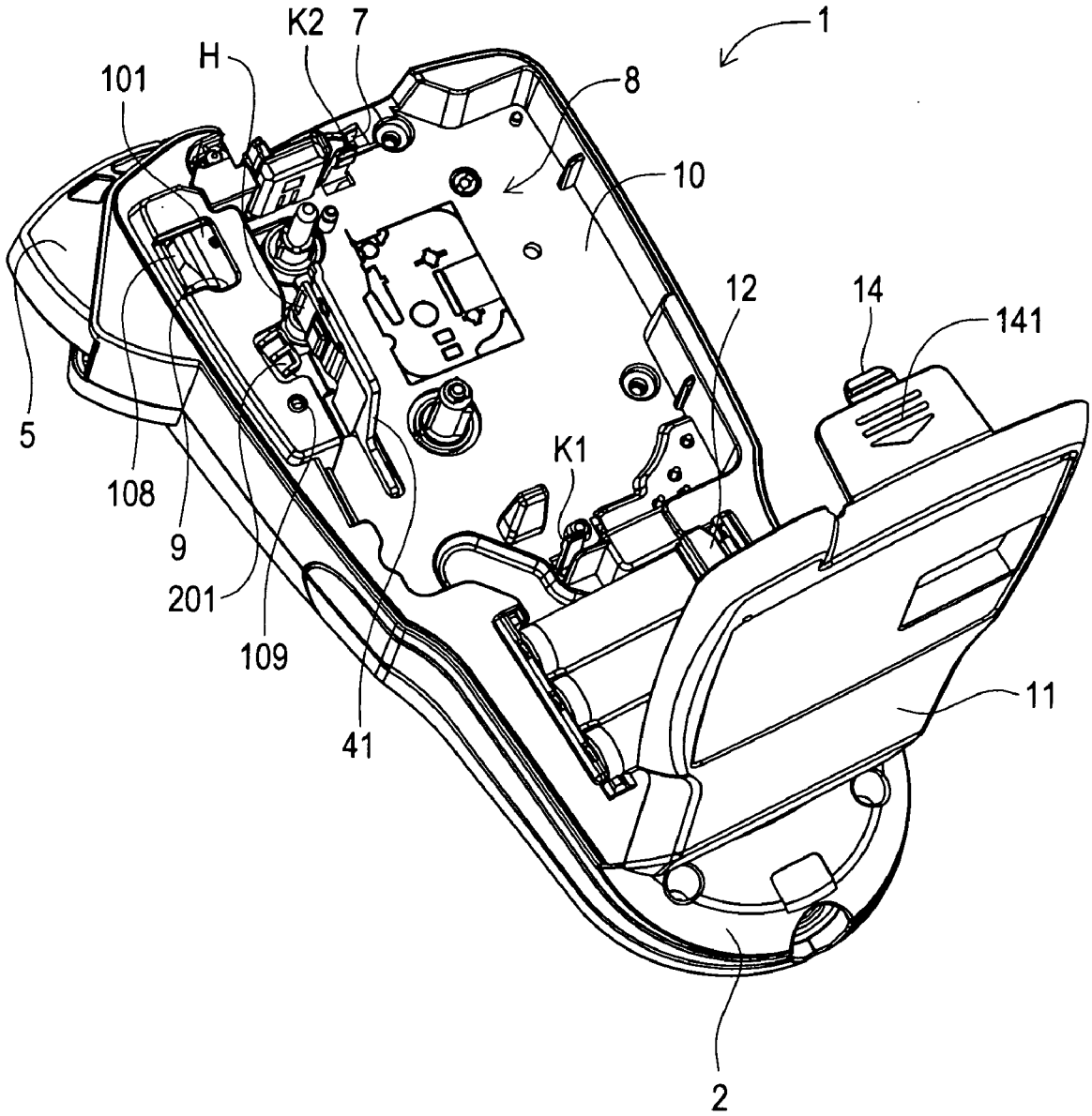
FIG. 5 is a perspective view showing an outer appearance of the tape printer in which the cover is open in a case wherein a cassette is not loaded, as seen from a back side of the tape printer.
Figure 6:
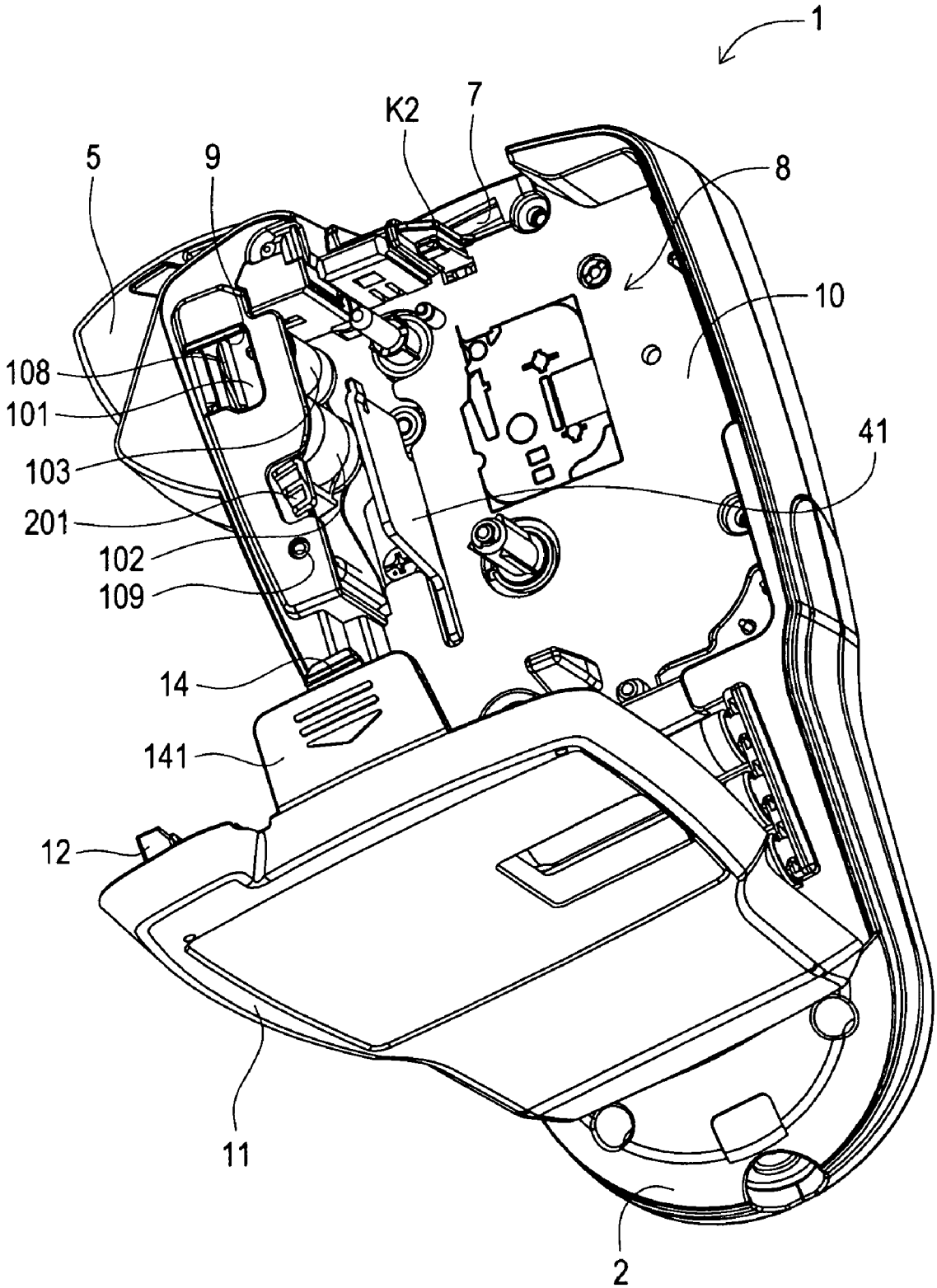
FIG. 6 is a perspective view showing an outer appearance of the tape printer in which the cover is open in a case wherein a cassette is not loaded, as seen from a back side of the tape printer.
Figure 7:
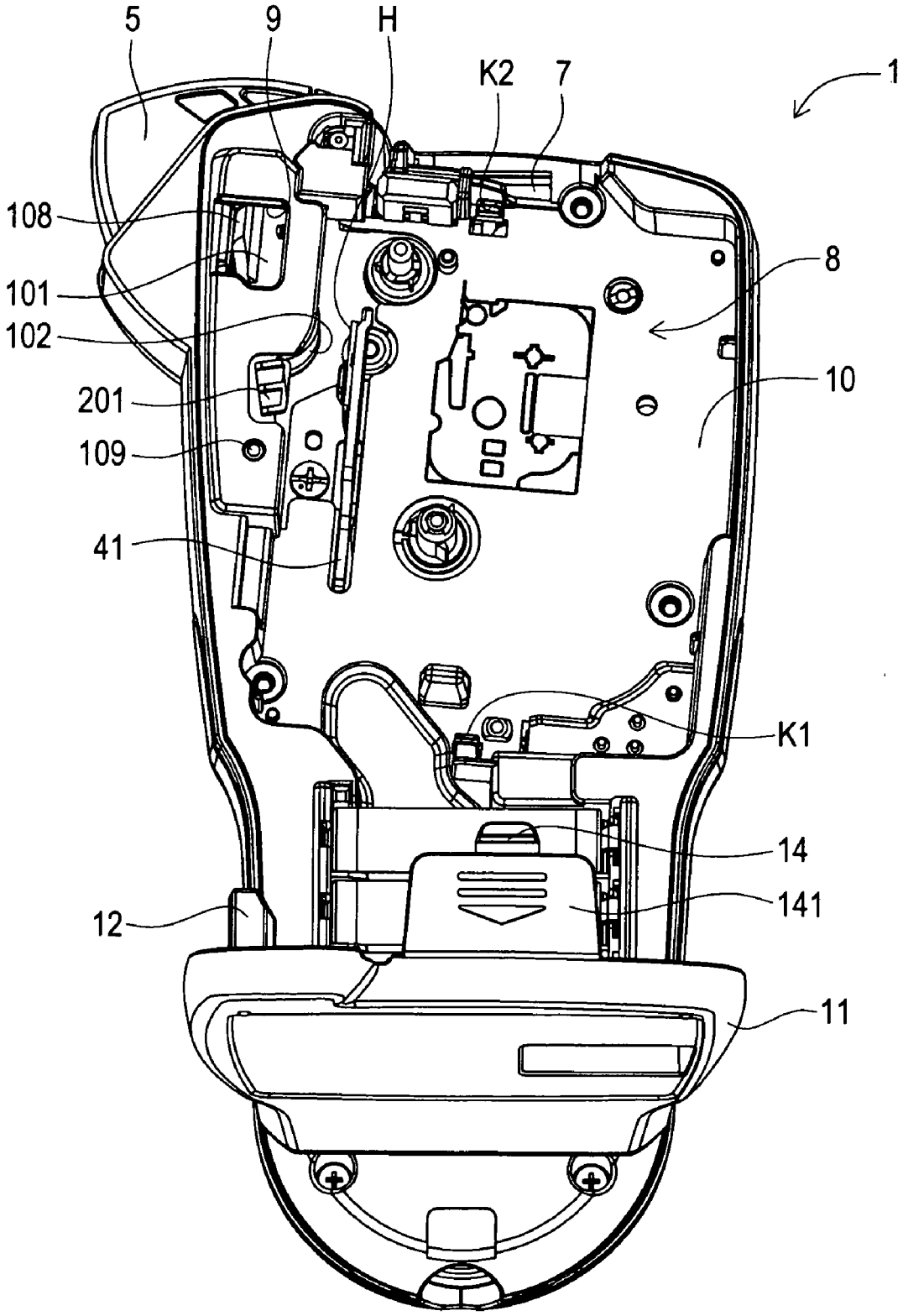
FIG. 7 is a perspective view showing an outer appearance of the tape printer in which the cover is open in a case wherein a cassette is not loaded, as seen from a back side of the tape printer.

A cassette loading portion 8 provided in the main body 2 is exposed when a cassette is not loaded and the cover 11 is open (refer to FIG. 5 through FIG. 7). The cassette loading portion 8 is formed with a loading inner face 10. The loading inner face 10 has a pair of engaging portions K1 and K2 and a supporting board 41 erected thereon.

Figure 8:
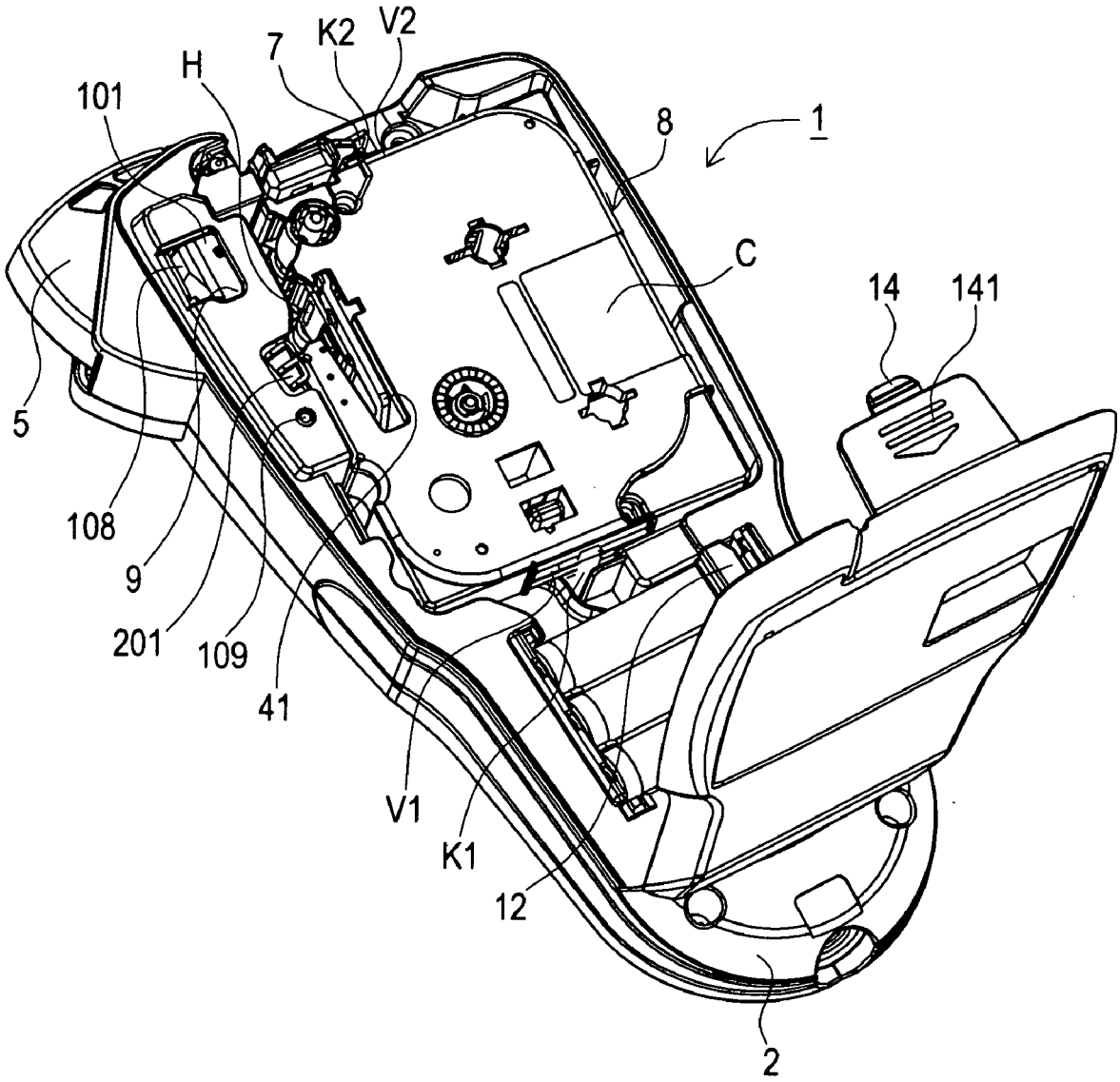
FIG. 8 is a perspective view showing an outer appearance of the tape printer in which the cover is open in a case wherein a cassette is accurately set, as seen from a back side of the tape printer.
Figure 9:
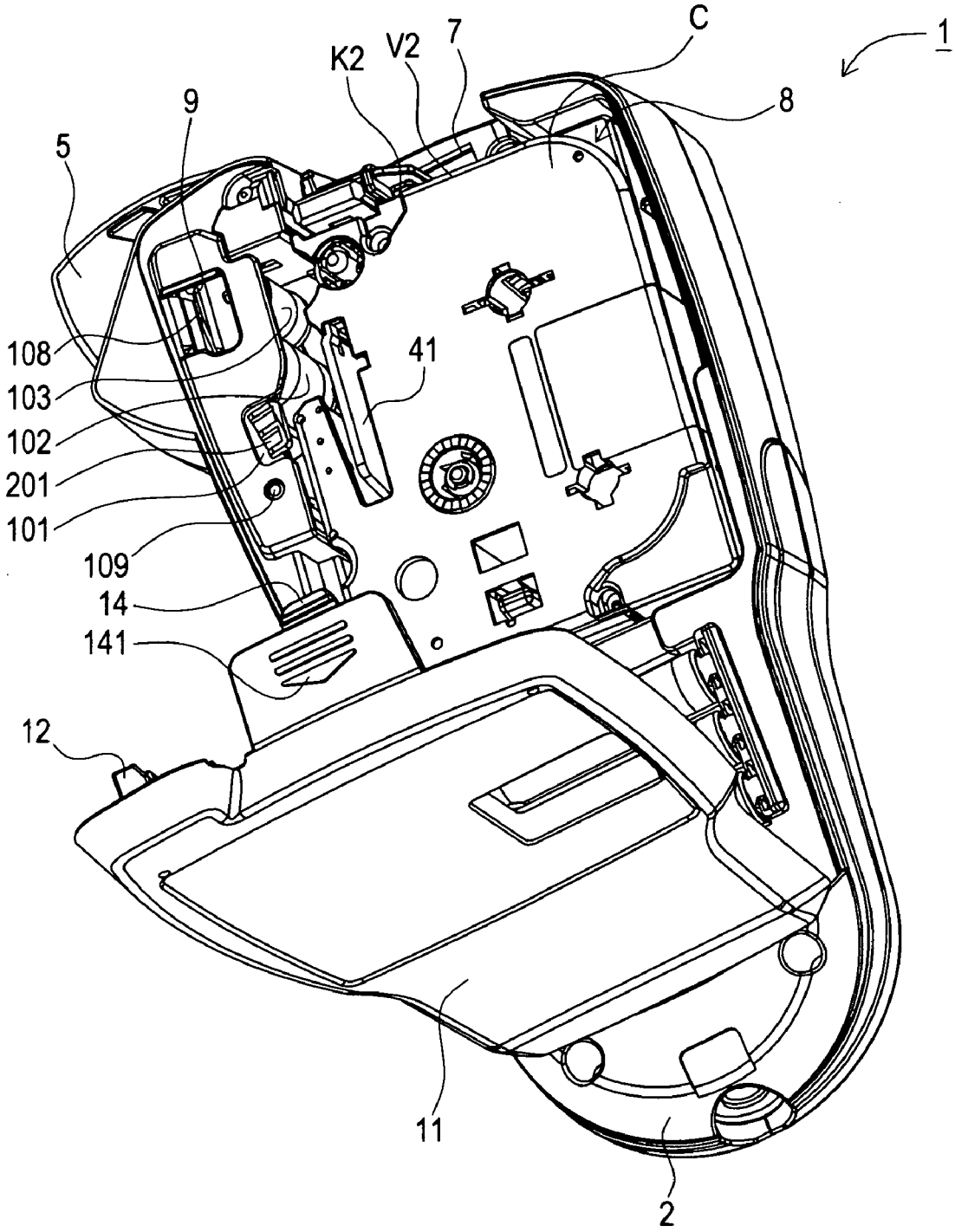
FIG. 9 is a perspective view showing an outer appearance of the tape printer in which the cover is open in a case wherein a cassette is accurately set, as seen from a back side of the tape printer.
Figure 10:
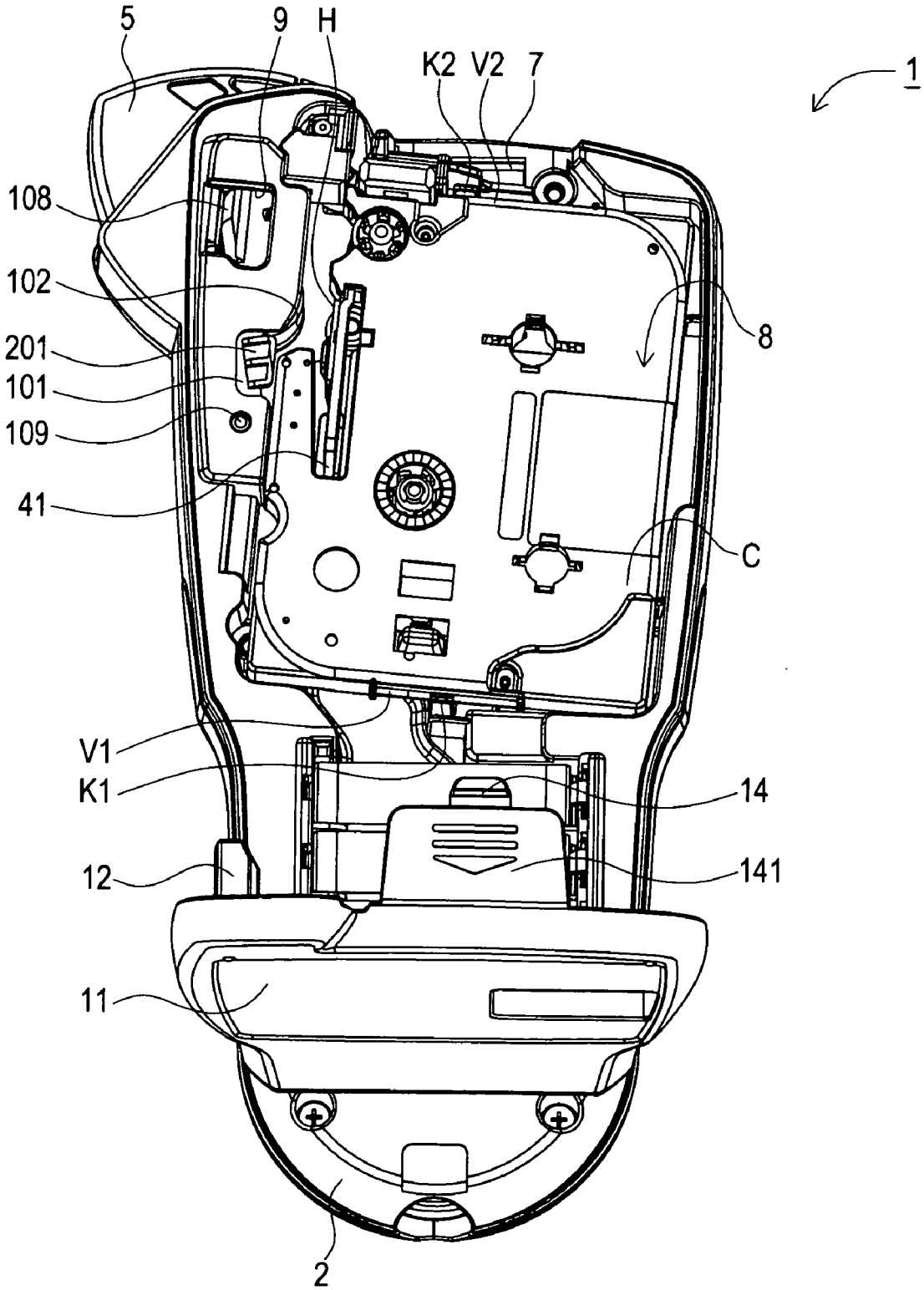
FIG. 10 is a perspective view showing an outer appearance of the tape printer in which the cover is open in a case wherein a cassette is accurately set, as seen from a back side of the tape printer.

A cassette C can be accurately set inside the cassette loading portion 8 by engaging the pair of engaging portions K1 and K2 with the cassette C which is placed in the cassette loading portion 8 (refer to FIG. 8 through FIG. 10). As a result, a bottom wall CA1 of the cassette C (refer to FIG. 22 and the like as will be described later) is attached to the loading inner face 10. A pair of liner protruding portions V1 and V2 are provided on the left and right side walls of the cassette C. When the cassette C is accurately set inside the cassette loading portion 8, the pair of engaging portions K1 and K2 are respectively engaged with the pair of liner protruding portions V1 and V2 of the cassette C.

Figure 31:
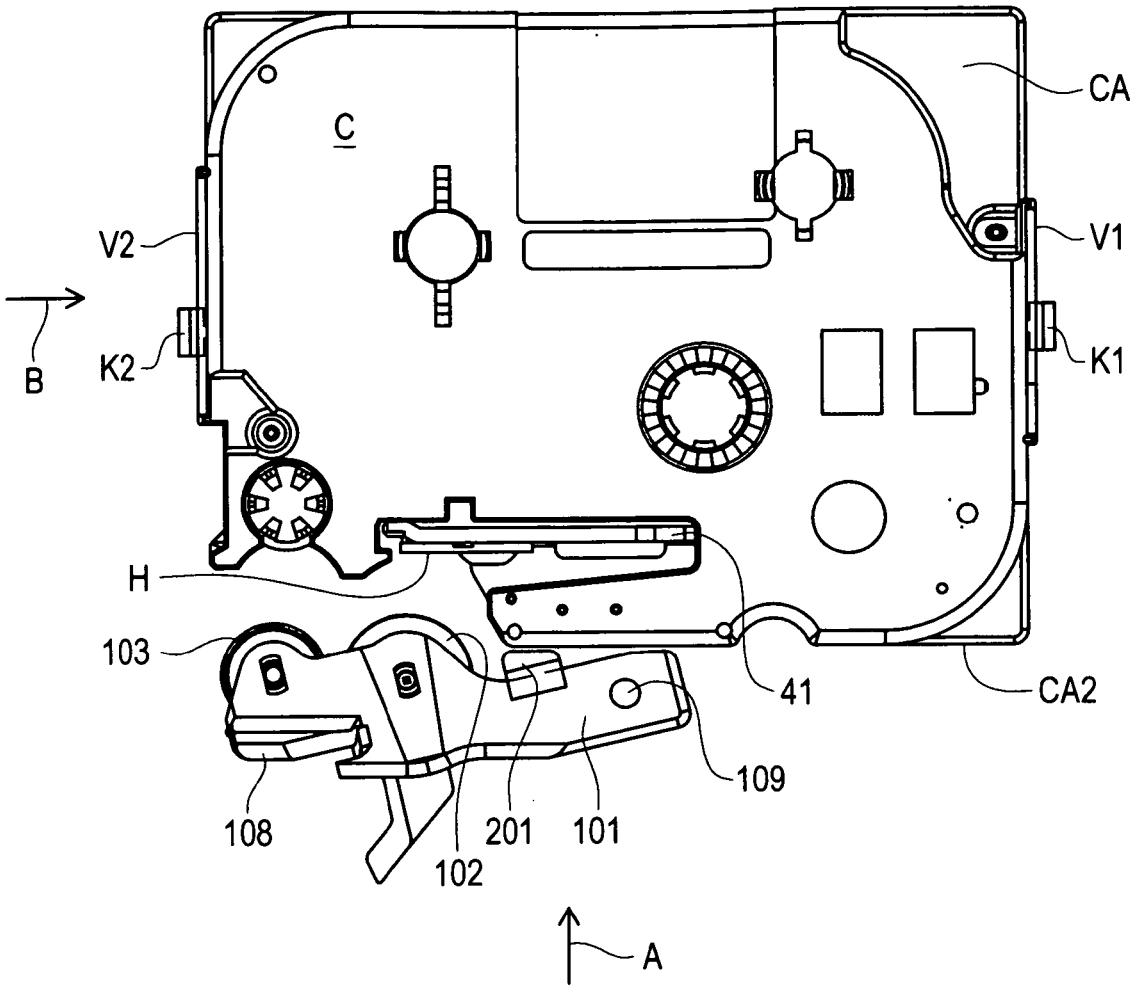
FIG. 31 is a plan view showing the positioning relationship between the projection of the roller holder and a cassette when a user attempts to press the roller holder against the supporting board, in a state wherein the cassette is not accurately set inside the cassette loading portion of the tape printer.
Figure 32:
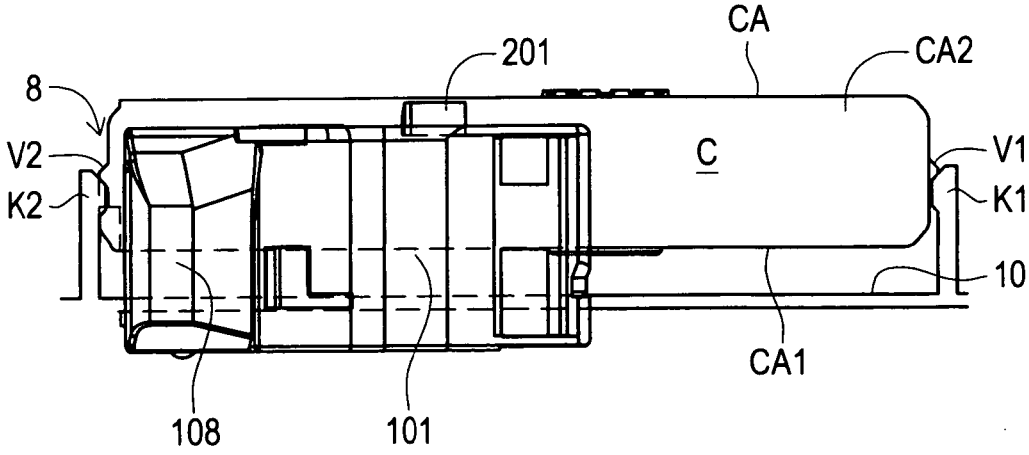
FIG. 32 is a view showing the positioning relationship between the projection of the roller holder and a cassette when a user attempts to press the roller holder against the supporting board, in a state wherein the cassette is not accurately set inside the cassette loading portion of the tape printer, and is a side view taken along arrow A in FIG. 31.
Figure 33:
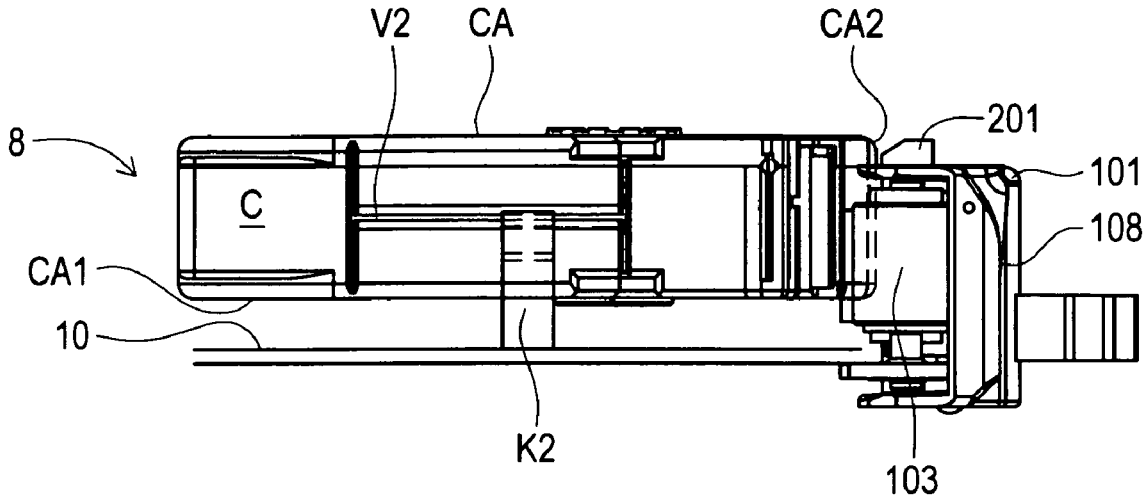
FIG. 33 is a view showing the positioning relationship between the projection of the roller holder and a cassette when a user attempts to press the roller holder against the supporting board, in a state wherein the cassette is not accurately set inside the cassette loading portion of the tape printer, and is a side view taken along arrow B in FIG. 31.
Figure 34:
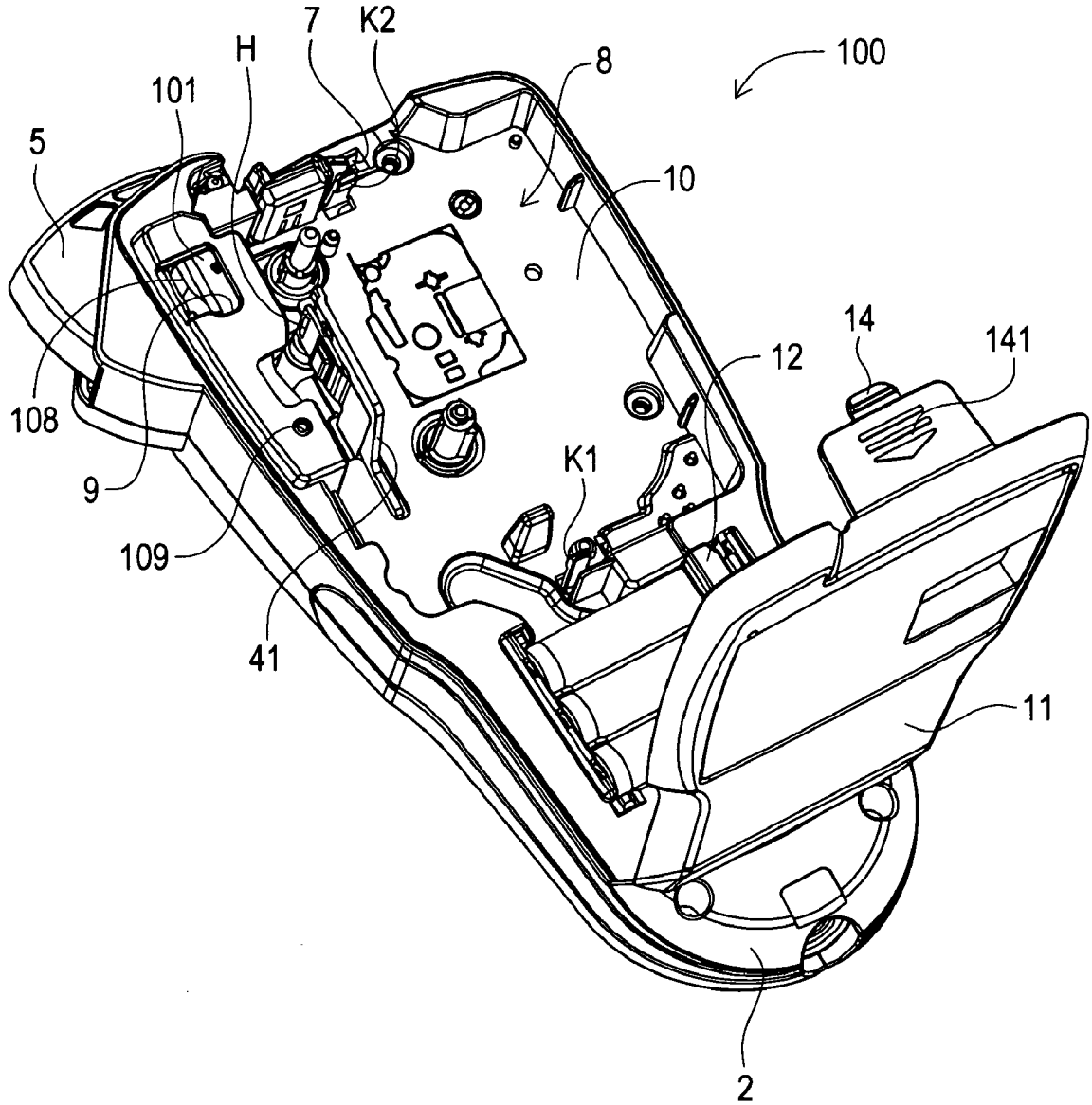
FIG. 34 is a perspective view showing an outer appearance of a tape printer according to a second embodiment in which a cover is open in a case wherein a cassette is not loaded, as seen from a back side of the tape printer.
Figure 35:
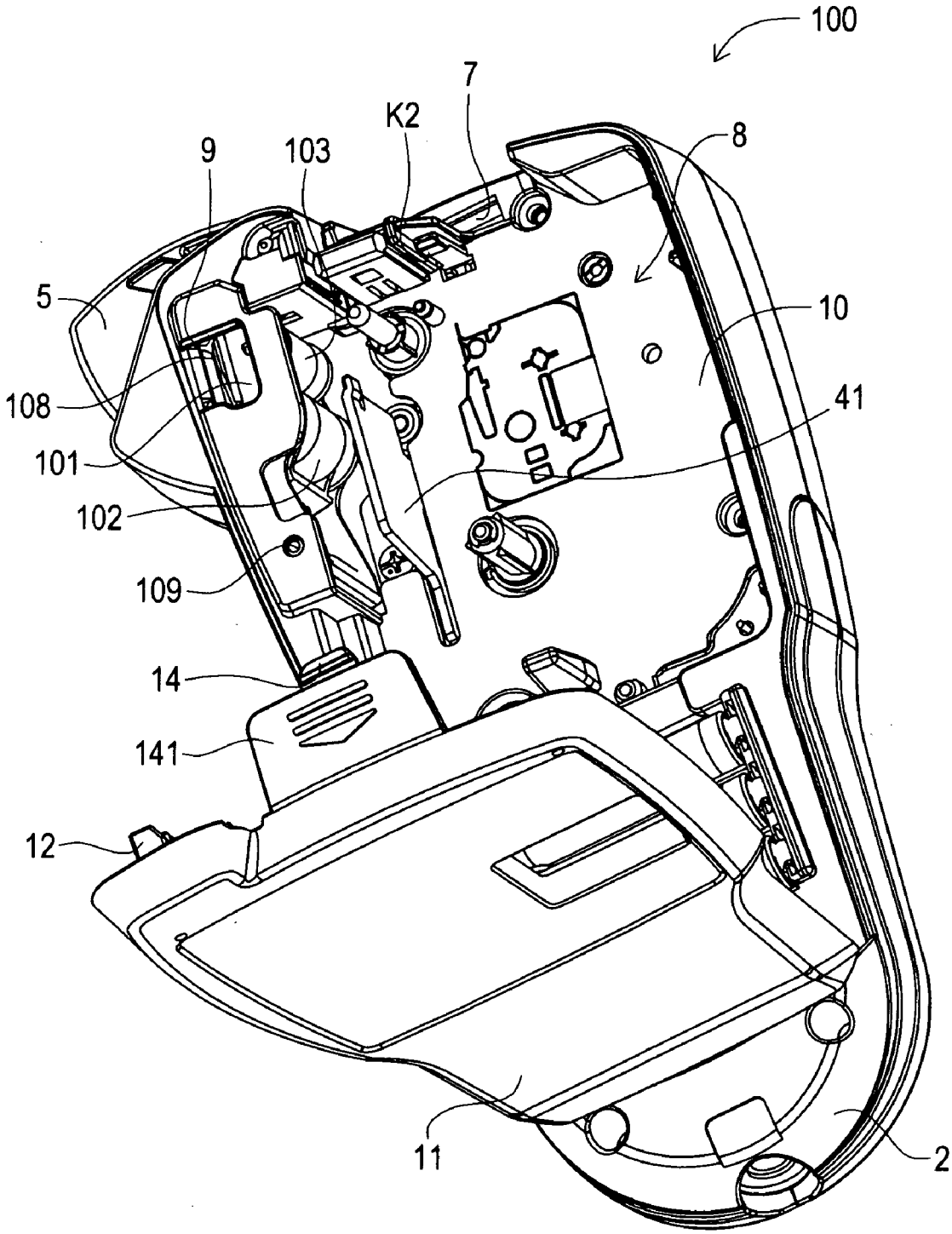
FIG. 35 is a perspective view showing an outer appearance of the tape printer in which the cover is open in a case wherein the cassette is not loaded, as seen from a back side of the tape printer.
Figure 36:
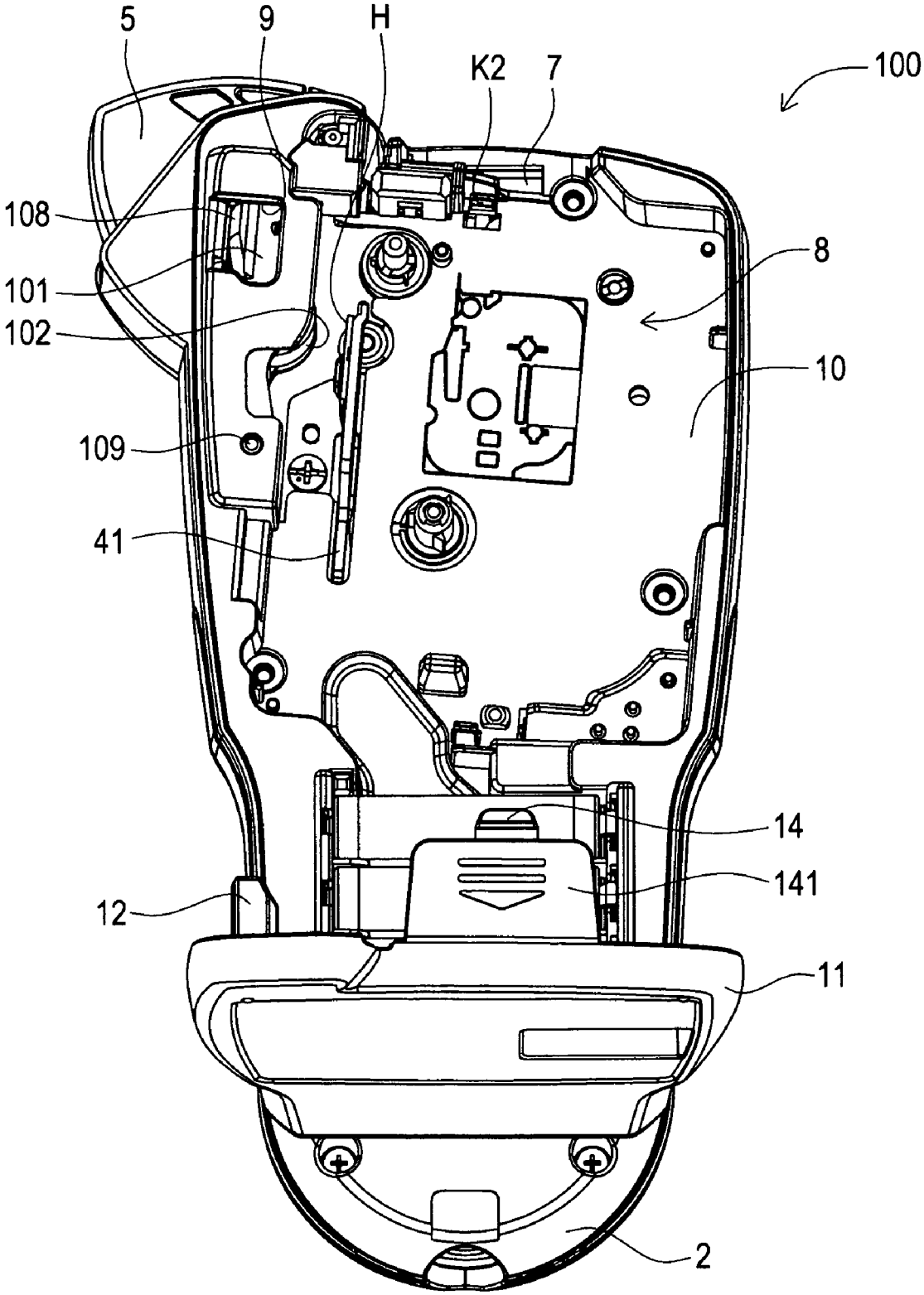
FIG. 36 is a perspective view showing an outer appearance of the tape printer in which the cover is open in a case wherein the cassette is not loaded, as seen from a back side of the tape printer.
Figure 37:
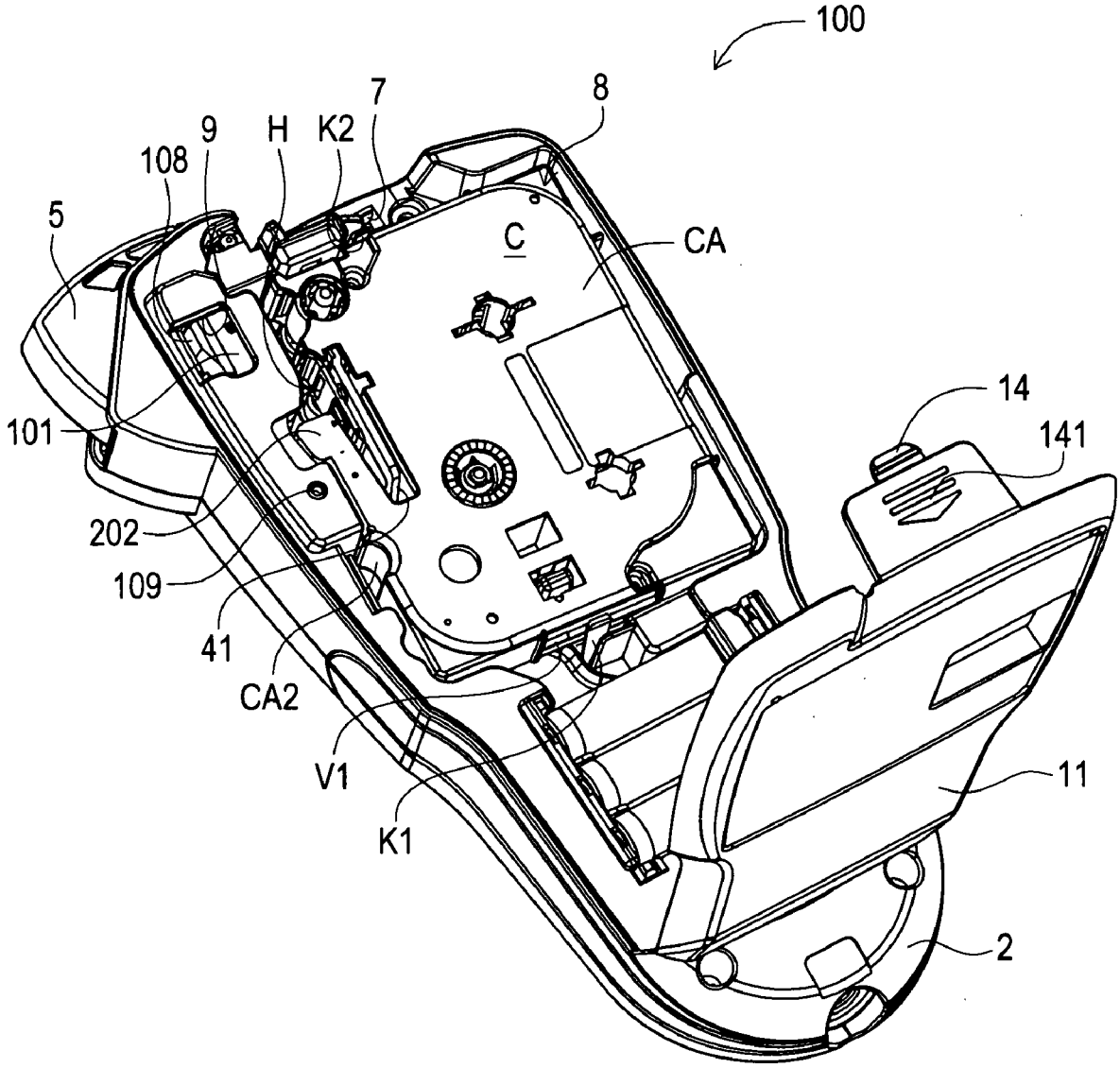
FIG. 37 is a perspective view showing an outer appearance of the tape printer in which the cover is open in a case wherein the cassette is accurately set, as seen from a back side of the tape printer.
Figure 38:
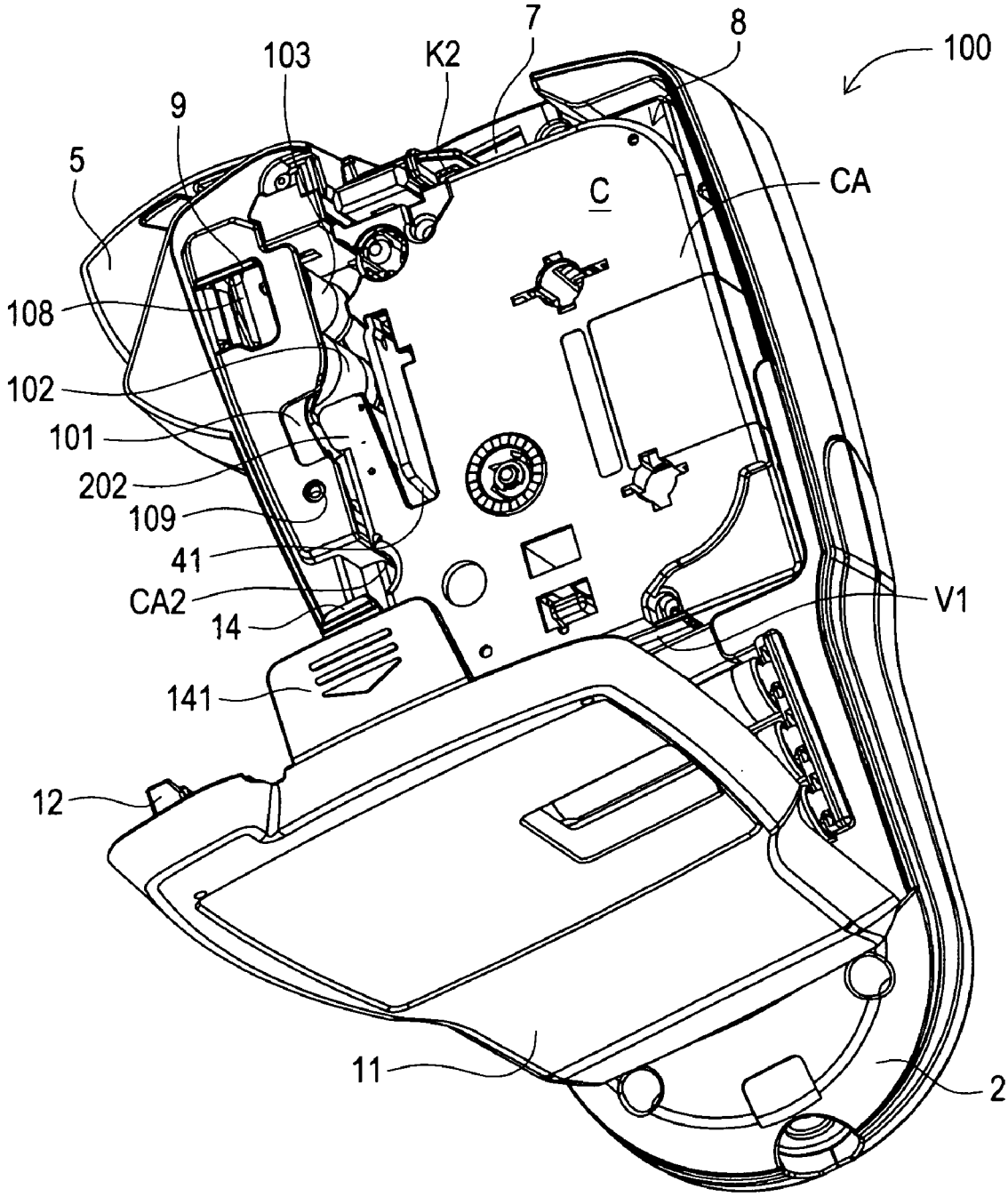
FIG. 38 is a perspective view showing an outer appearance of the tape printer in which the cover is open in a case wherein the cassette is accurately set, as seen from a back side of the tape printer.
Figure 39:
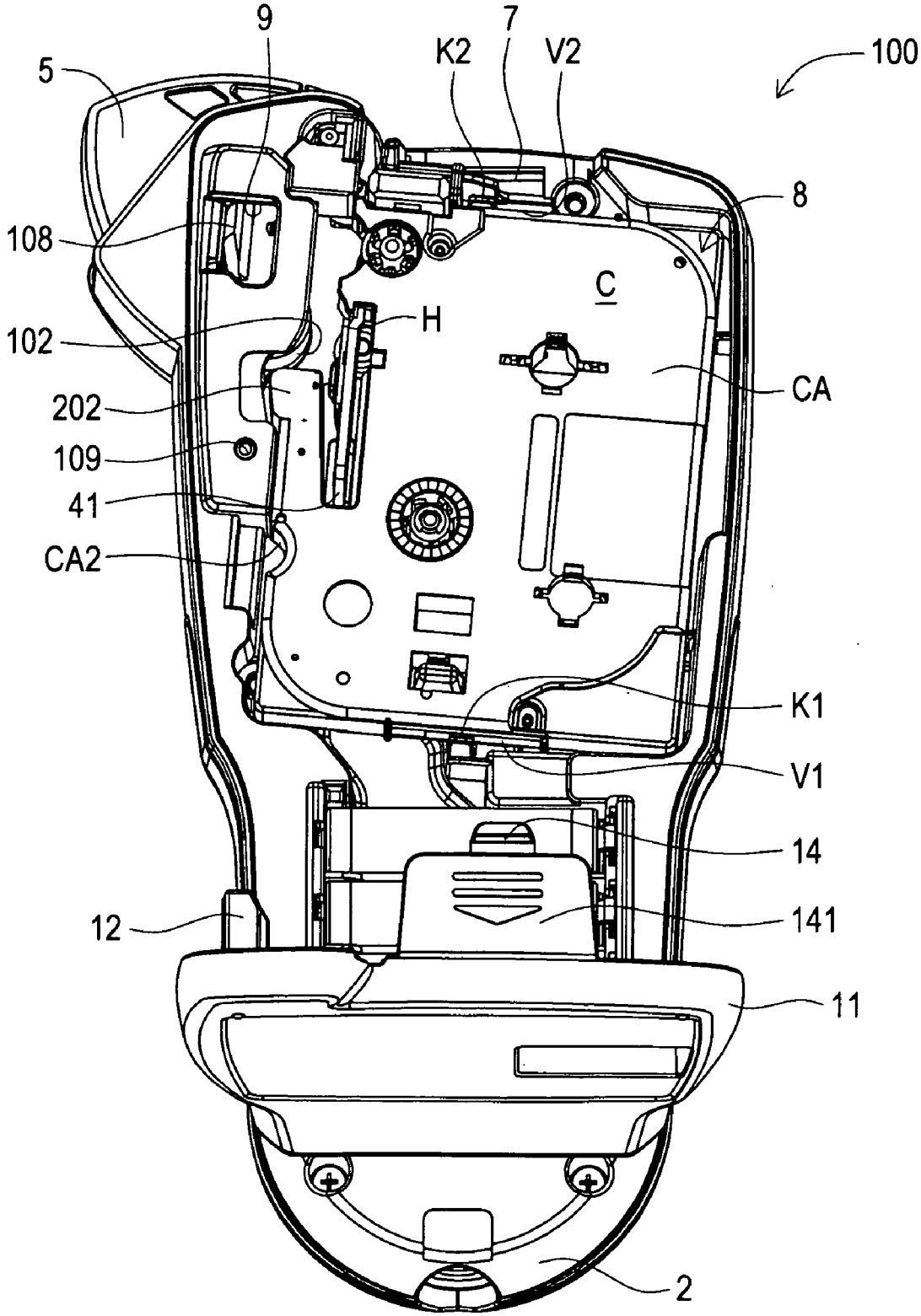
FIG. 39 is a perspective view showing an outer appearance of the tape printer in which the cover is open in a case wherein the cassette is accurately set, as seen from a back side of the tape printer.

Accordingly, as shown in FIG. 31 through FIG. 33 as will be described later, for instance, when the printer 1 is left in a state wherein the pair of liner protruding portions V1 and V2 of the cassette C are respectively placed on the pair of engaging portions K1 and K2, a condition is maintained wherein the cassette C is not accurately set inside the cassette loading portion 8.

The supporting board 41 has a thermal head H and the like (refer to FIG. 5, FIG. 7, FIG. 8 and FIG. 10).

A roller holder 101 is provided in the vicinity of the cutter lever 5 of the main body 2. The roller holder 101 is rotatably supported on the main body 2 by a rotating shaft 109. Further, the roller holder 101 is biased from inward to outward of the cassette loading portion 8 by a coil spring not shown. A platen roller 102 and a tape feeding sub-roller 103 are supported around a shaft inside the roller holder 101 (refer to FIG. 6, FIG. 7, FIG. 9 and FIG. 10).

A pressing surface 108 is formed on an outer surface of the roller holder 101. An insertion/ejection portion 9 from wherein the pressing surface 108 is exposed is provided in the main body 2. When the cover 11 is attached to the main body 2, the protruding portion 12 of the cover 11 is inserted in the insertion/ejection portion 9. At this time, the protruding portion 12 slides on the pressing surface 108 and the roller holder 101 rotates in an anti-biasing direction (direction from outward to inward the cassette loading portion 8). As a result, the platen roller 102 is pressed against the thermal head H with a tape-like film of the cassette C being held thereinbetween. This operation is the same for a case wherein the cassette C is not loaded in the cassette loading portion 8. However, in this case, the platen roller 102 is directly pressed against the thermal head H without the tape-like film of the cassette C being held thereinbetween.

Figure 11:
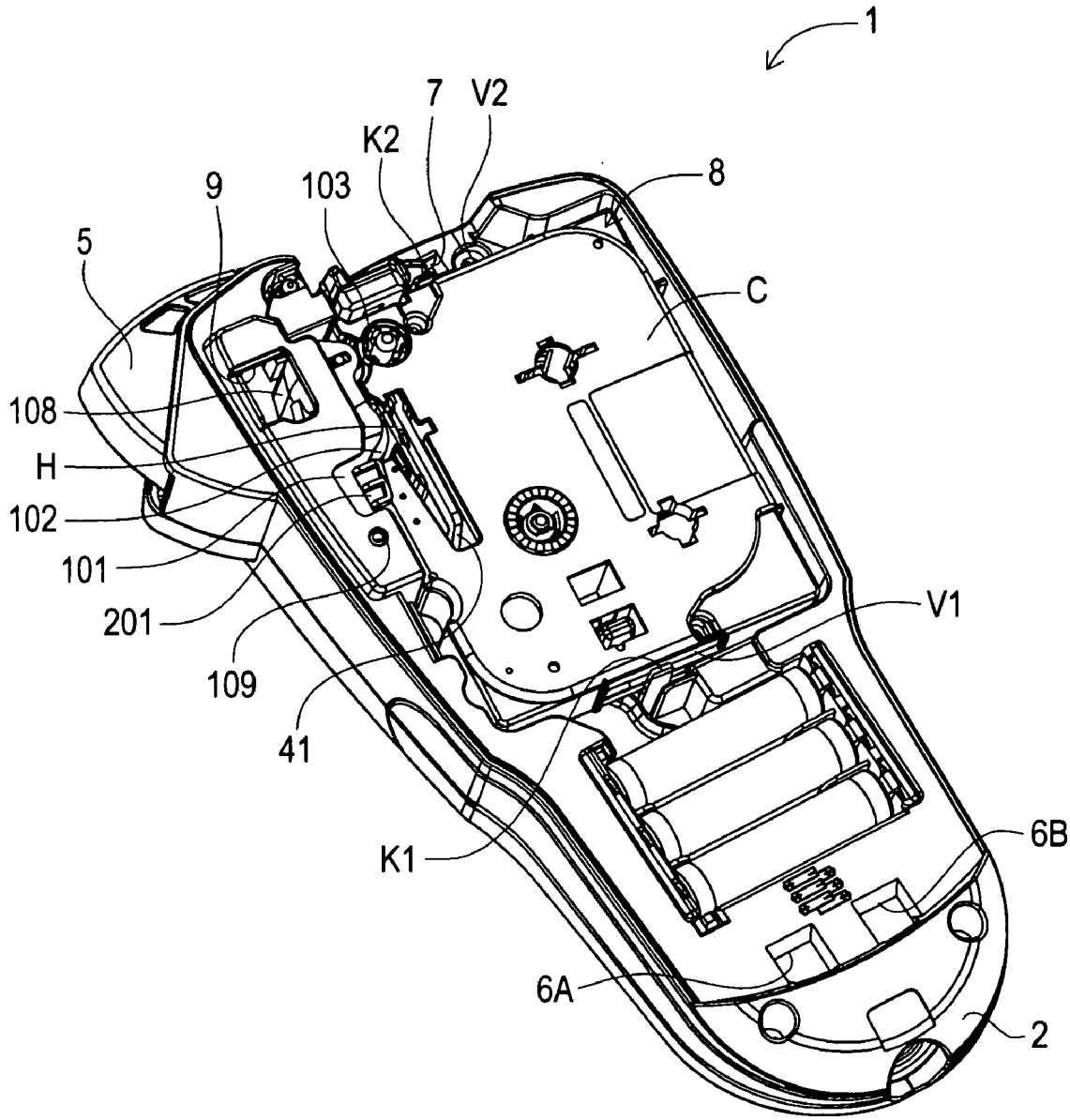
FIG. 11 is a perspective view showing an outer appearance of the tape printer in which the platen roller is pressed against the thermal head when a cassette is loaded, as seen from a back side of the tape printer.
Figure 12:
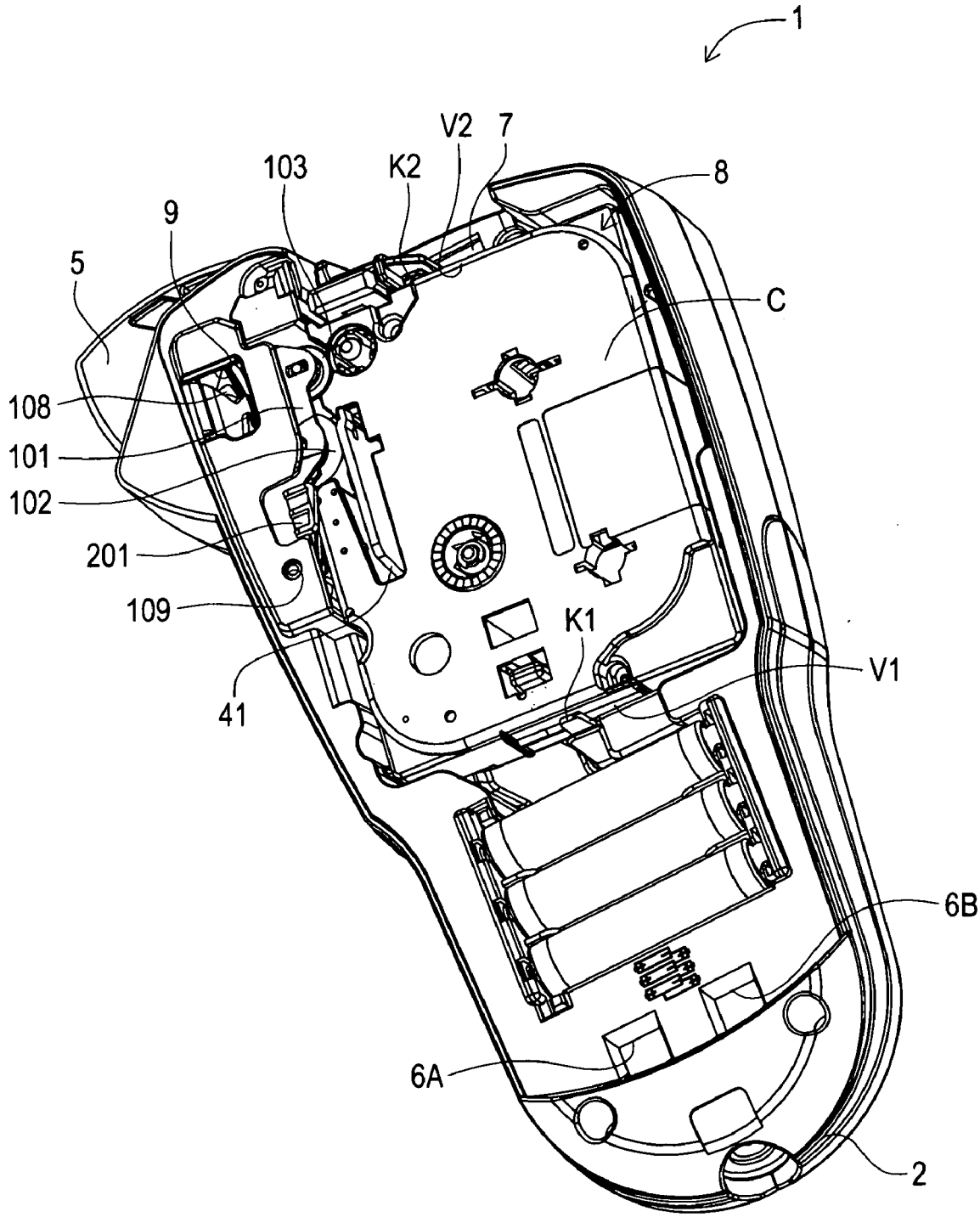
FIG. 12 is a perspective view showing an outer appearance of the tape printer in which the platen roller is pressed against the thermal head when a cassette is loaded, as seen from a back side of the tape printer.
Figure 13:
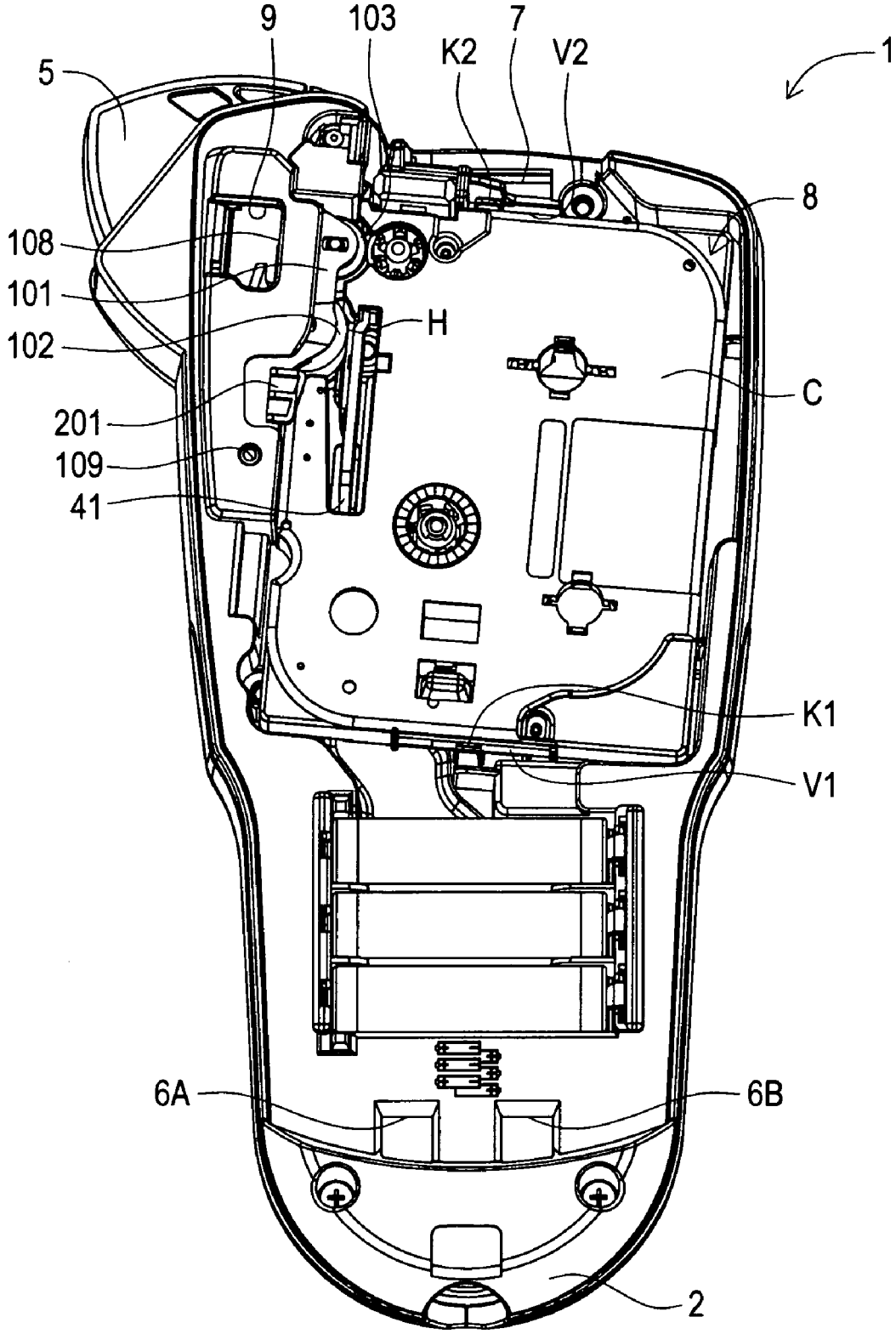
FIG. 13 is a perspective view showing an outer appearance of the tape printer in which the platen roller is pressed against the thermal head when a cassette is loaded, as seen from a back side of the tape printer.

FIG. 11 through FIG. 13 show a state wherein the platen roller 102 is pressed against the thermal head H with the tape-like film of the cassette C being held thereinbetween, by attaching the cover 11 to the main body 2, when the cassette C is accurately set inside the cassette loading portion 8. FIG. 11 through FIG. 13 show the state that the platen roller 102 is pressed against the thermal head H and therefore, the tape-like film of the cassette C and the cover 11 are omitted from the drawings.

When the cover 11 is removed from the main body 2, the protruding portion 12 of the cover 11 is pulled out from the insertion/ejection port 9. At this time, the protruding portion 12 is disengaged from the pressing surface 108 and the roller holder 101 is rotated in a biasing direction (direction from inward to outward of the cassette loading portion 8). As a result, the platen roller 102 is detached from the thermal head H (refer to FIG. 8 through FIG. 10).

A pair of first engaging ports 6A and 6B (refer to FIG. 11 through FIG. 13) and a second engaging port 7 is provided in the main body 2 at the periphery of the cassette loading portion 8. When attaching the cover 11 to the main body 2, the first engaging claws 13A and 13B of the cover 11 are respectively hooked with the first engaging ports 6A and 6B. When the cover 11 is attached to the main body 2, the second engaging port 7 engages with the second engaging claw 14 of the cover 11. Accordingly, when the cover 11 is attached to the main body 2, if a user depresses a convex depressing portion 141 provided in the vicinity of the second engaging claw 14, the second engaging claw 14 is disengaged from the second engaging port 7, making it possible to remove the cover 11 from the main body 2.

Figure 14:
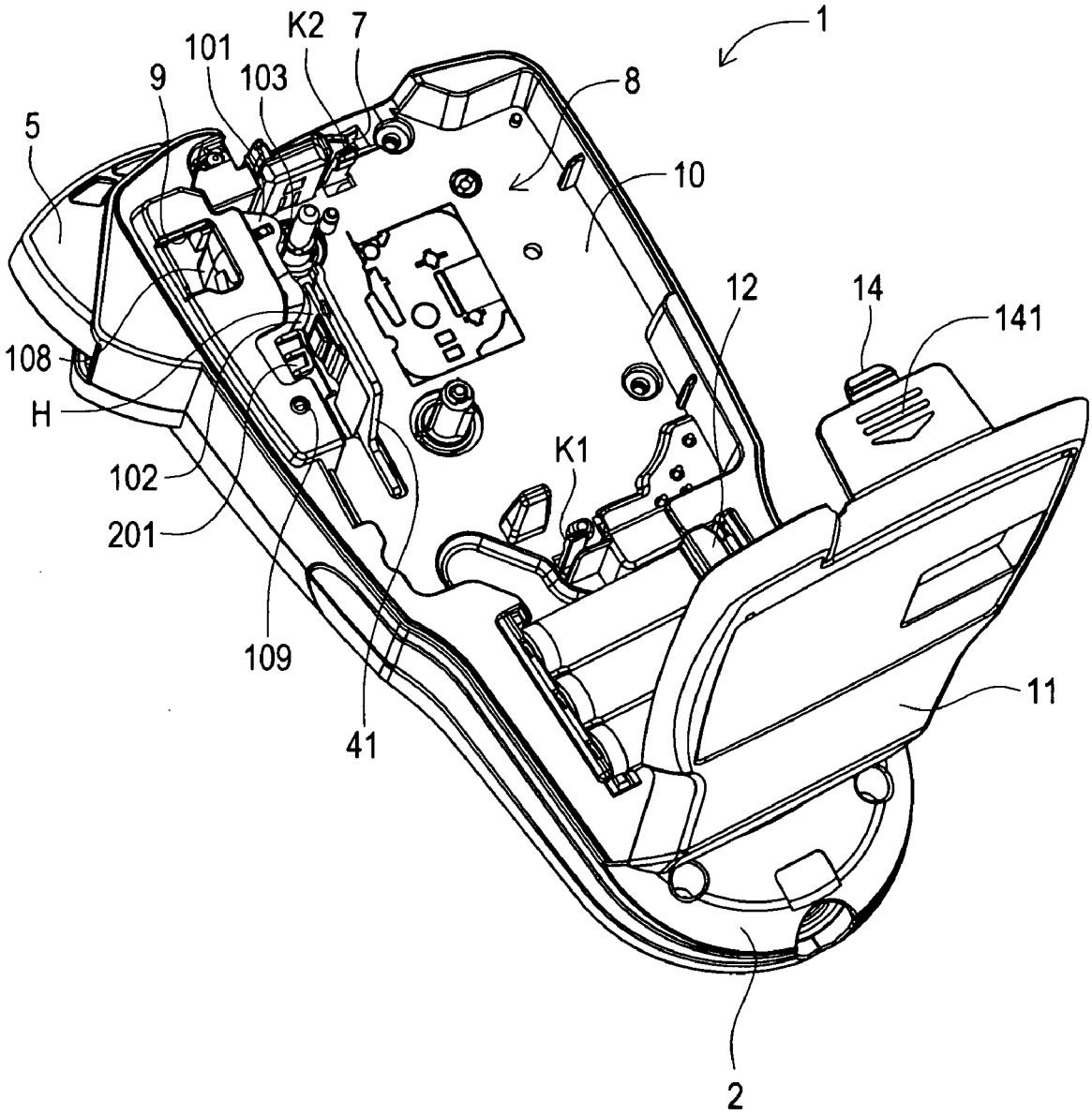
FIG. 14 is a perspective view showing an outer appearance of the tape printer in which the cover is open and the platen roller which adhered to the thermal head is exposed, in a case wherein a cassette is not loaded in the cassette loading portion, as seen from a back side of the tape printer.
Figure 15:
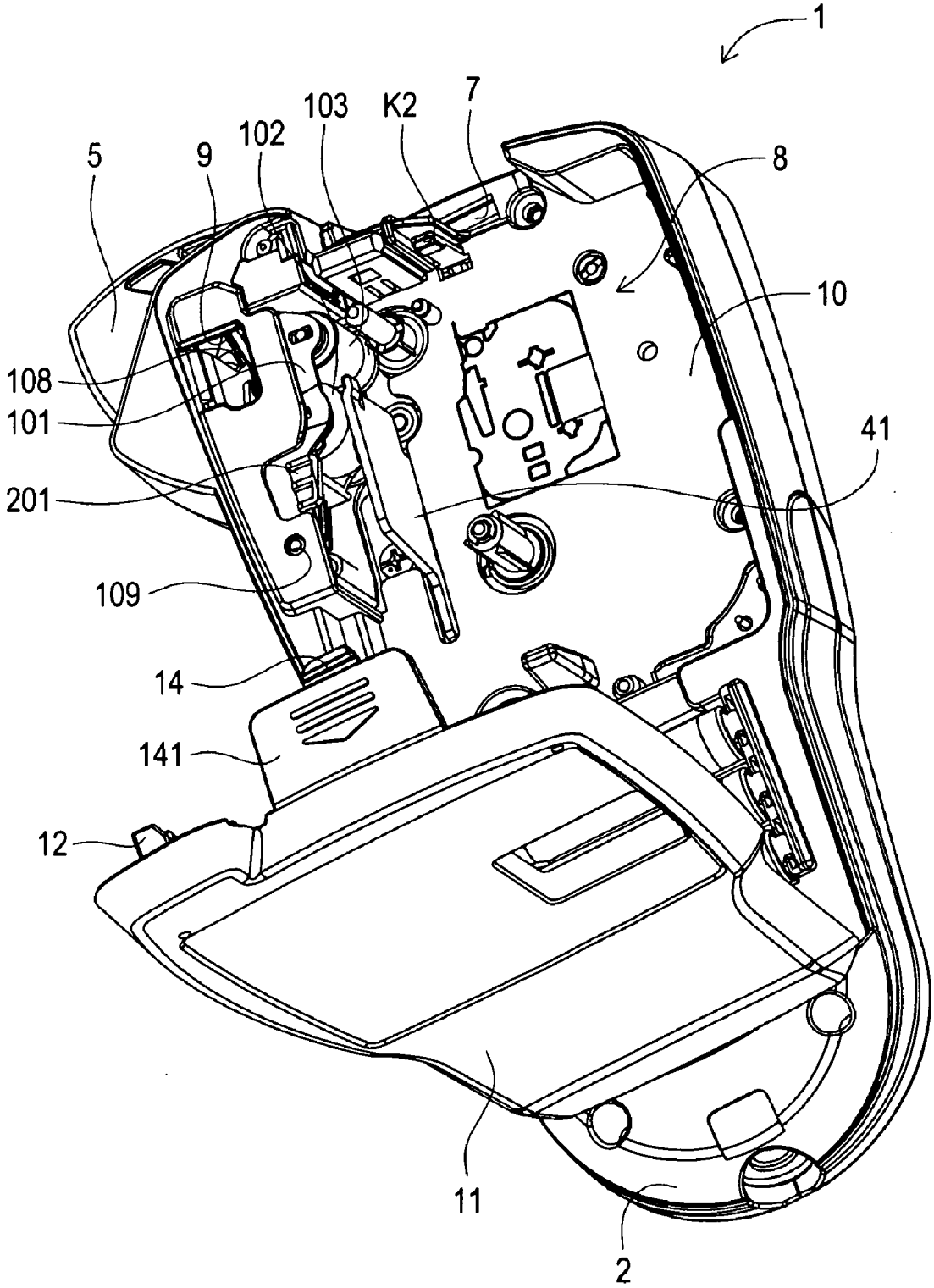
FIG. 15 is a perspective view showing an outer appearance of the tape printer in which the cover is open and the platen roller which adhered to the thermal head is exposed, in a case wherein a cassette is not loaded in the cassette loading portion, as seen from a back side of the tape printer.
Figure 16:
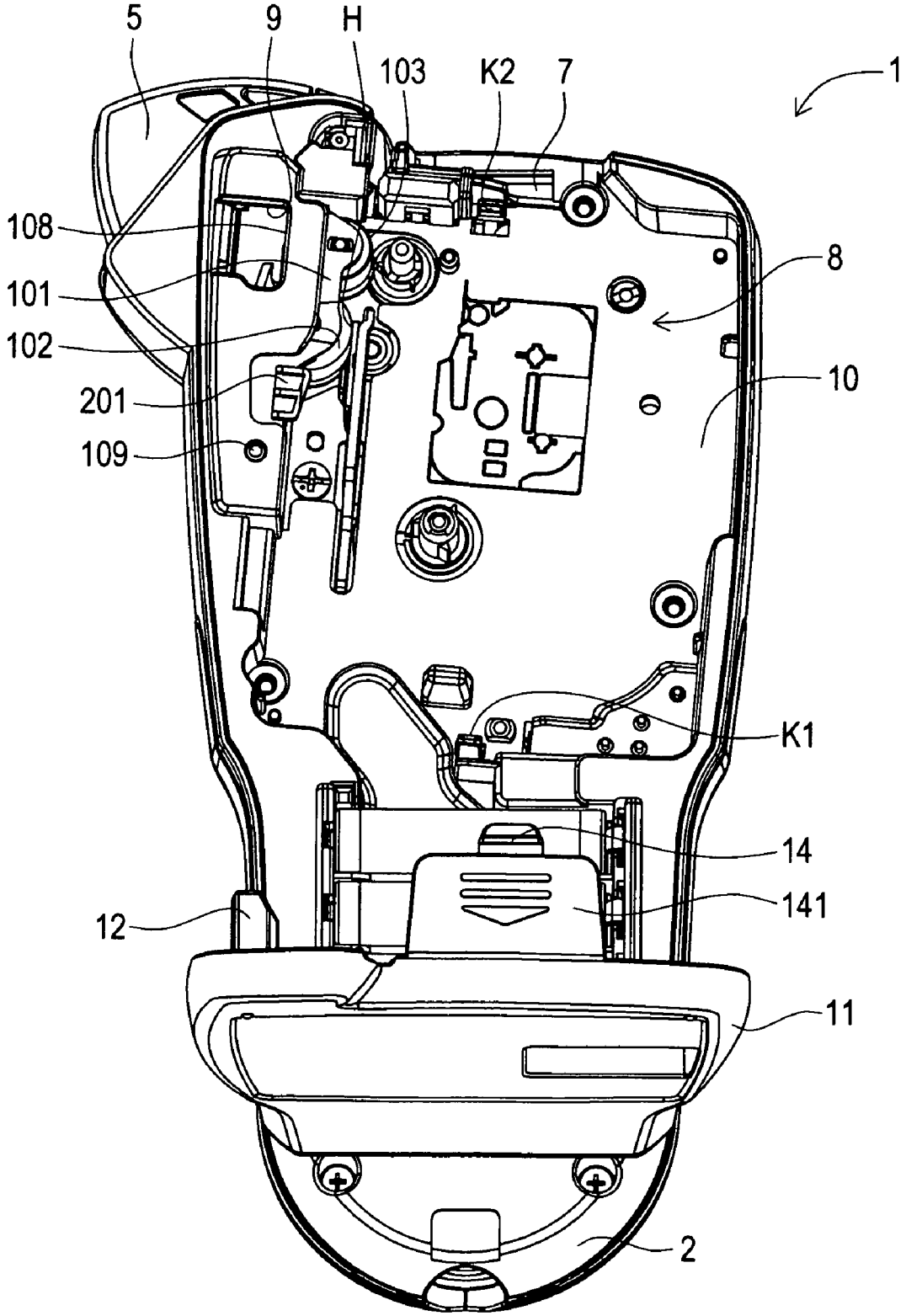
FIG. 16 is a perspective view showing an outer appearance of the tape printer in which the cover is open and the platen roller which adhered to the thermal head is exposed, in a case wherein a cassette is not loaded in the cassette loading portion, as seen from a back side of the tape printer.

In a case wherein the cassette C is not loaded in the cassette loading portion 8, once the cover 11 is attached to the main body 2, the platen roller 102 is directly pressed against the thermal head H, as was described earlier. If the tape printer 1 is left in this state at high temperature for an extended period of time ongoingly, the platen roller 102 may adhere to the thermal head H as is shown in FIG. 14 through FIG. 16 show a state wherein the cover 11 is open and the platen roller 102 which adhered to the thermal head H is exposed, in a case wherein the cassette C is not loaded in the cassette loading portion 8.

Figure 17:
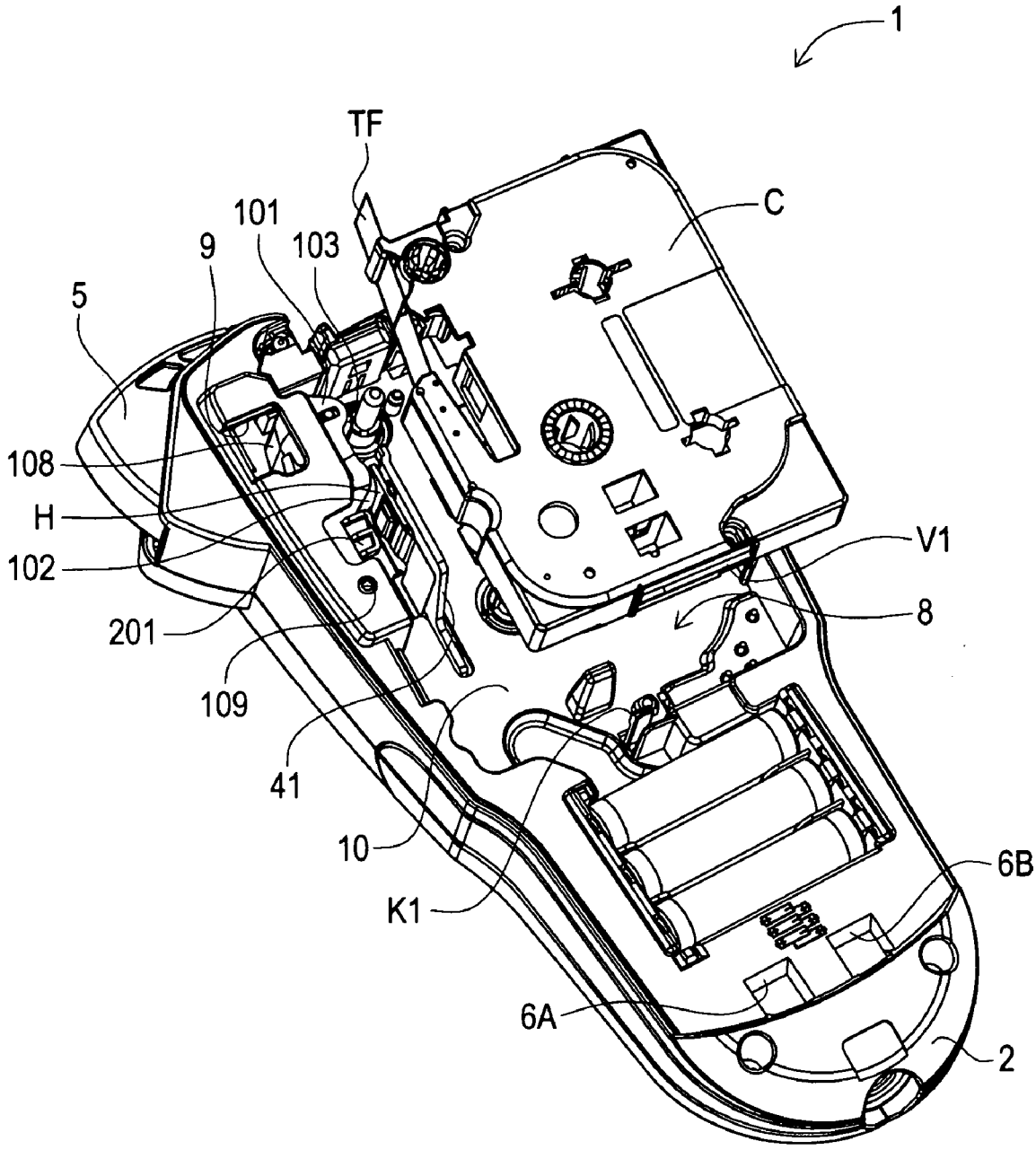
FIG. 17 is a perspective view showing an outer appearance of the tape printer in which a cassette is loaded inside the cassette loading portion when the cover is removed under a condition wherein the platen roller adhered to the thermal head, as seen from a back side of the tape printer.
Figure 18:
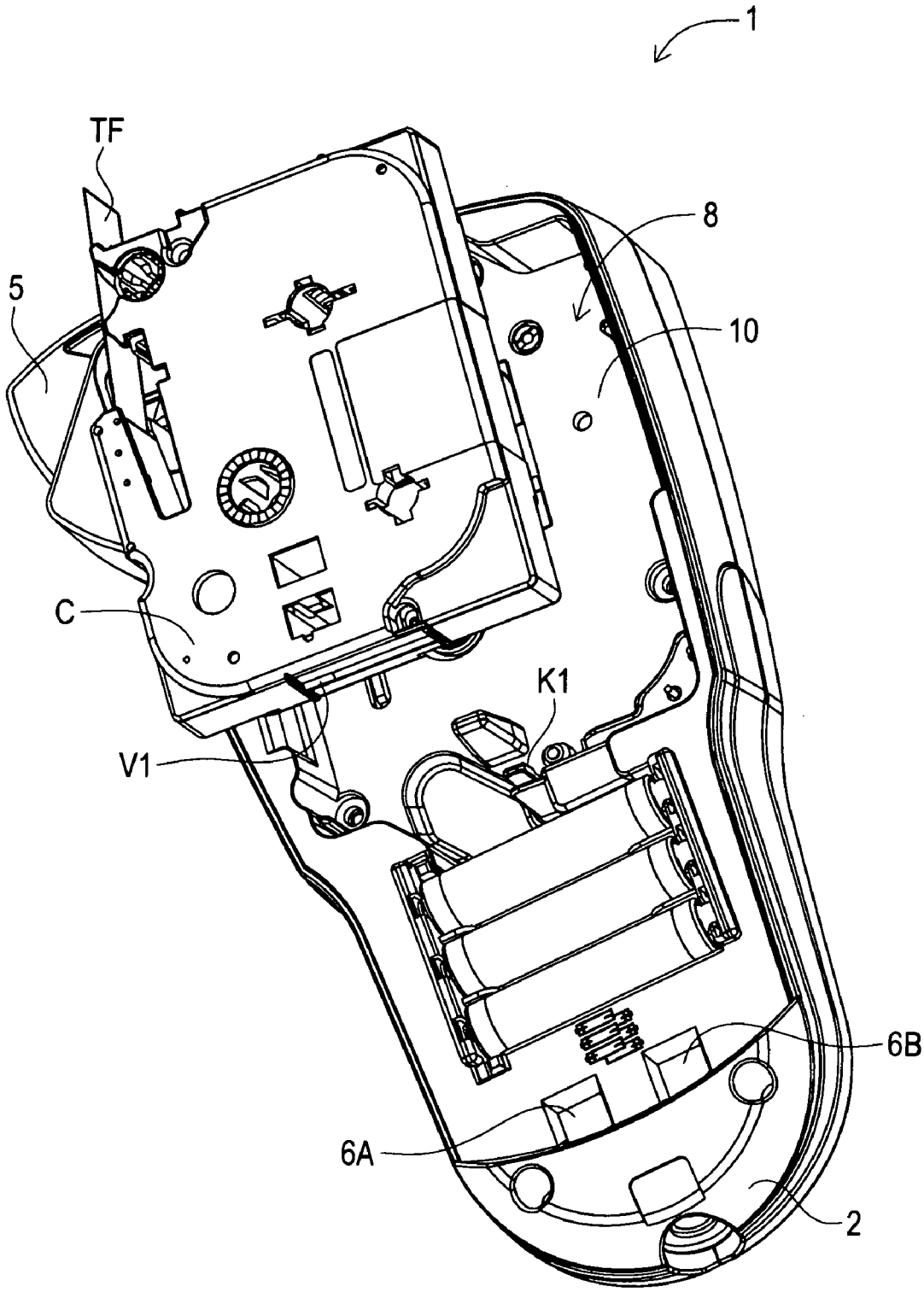
FIG. 18 is a perspective view showing an outer appearance of the tape printer in which a cassette is loaded inside the cassette loading portion when the cover is removed under a condition wherein the platen roller adhered to the thermal head, as seen from a back side of the tape printer.
Figure 19:
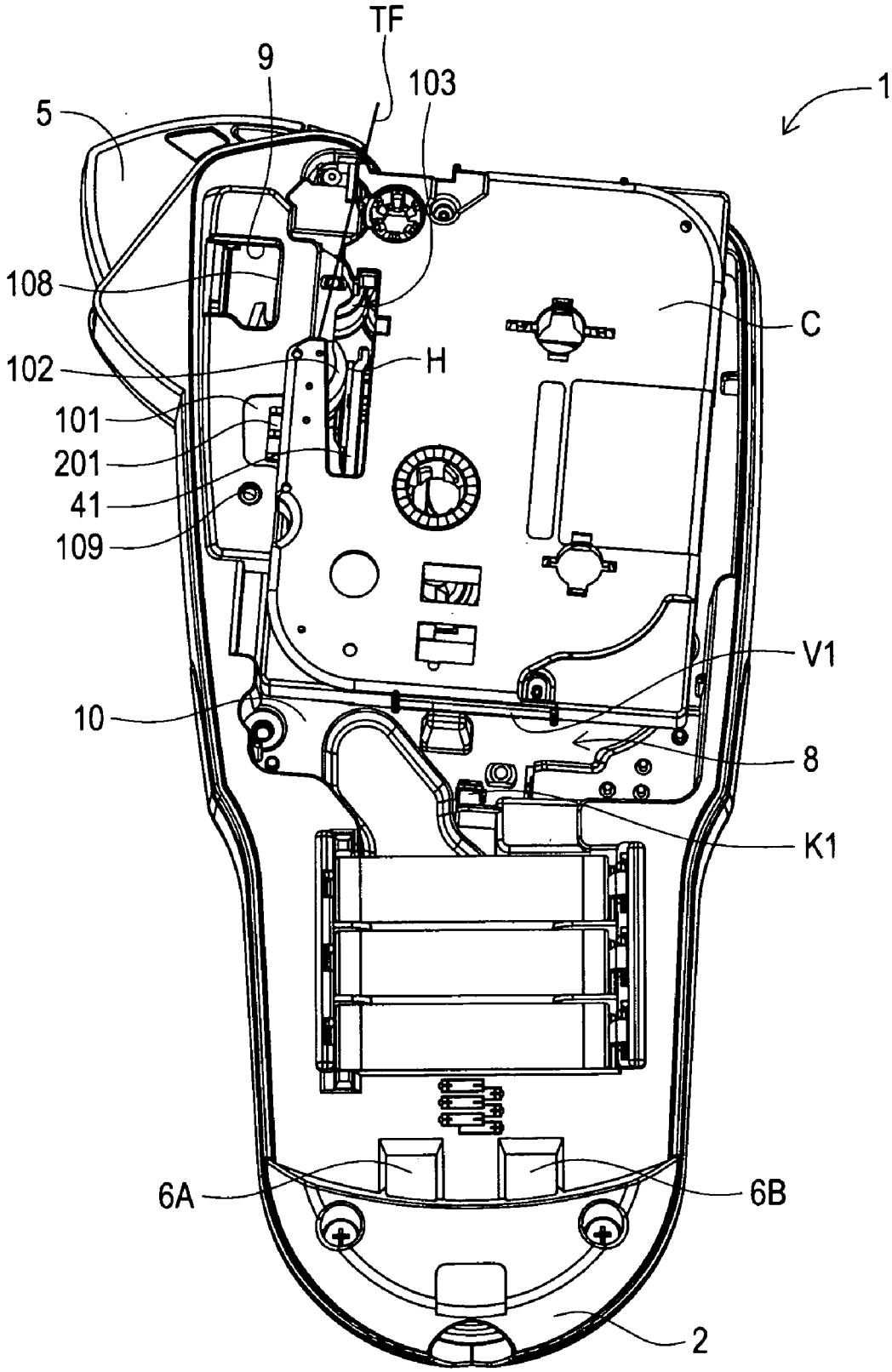
FIG. 19 is a perspective view showing an outer appearance of the tape printer in which a cassette is loaded inside the cassette loading portion when the cover is removed under a condition wherein the platen roller adhered to the thermal head, as seen from a back side of the tape printer.

Thus, if the platen roller 102 which has adhered to the thermal head H is exposed, a tape-like film TF of the cassette C will hit the platen roller 102 and the like when a user attempts to load the cassette C inside the cassette loading portion 8, as shown in FIG. 17 through FIG. 19. FIG. 17 through FIG. 19 show a state wherein an attempt is made to load the cassette C inside the cassette loading portion 8, in a state wherein the cover 11 is removed and the platen roller 102 adhered to the thermal head H.

2. Outline of Projection

In the tape printer 1 according to the first embodiment, a projection 201 which projects towards the cassette loading portion 8 is provided in the roller holder 101, as shown in FIG. 5 through FIG. 17 and FIG. 19. The surface of the projection 201 which faces the cover 11 as attached to the main body 2 is formed as a slant surface which extends and is slanted from a base to a tip thereof.

3. Positioning Relationship Between Projection and Cassette

When accurately set inside the cassette loading portion 8, the cassette C has a cassette case CA made up of the bottom wall CA1 facing the loading inner surface 10 of the cassette loading portion 8 and a front side wall CA2 which is continued from the bottom wall CA1 and faces the roller holder 101. In FIG. 20 through FIG. 30, the tape-like film TF of the cassette C is not shown.

Figure 20:
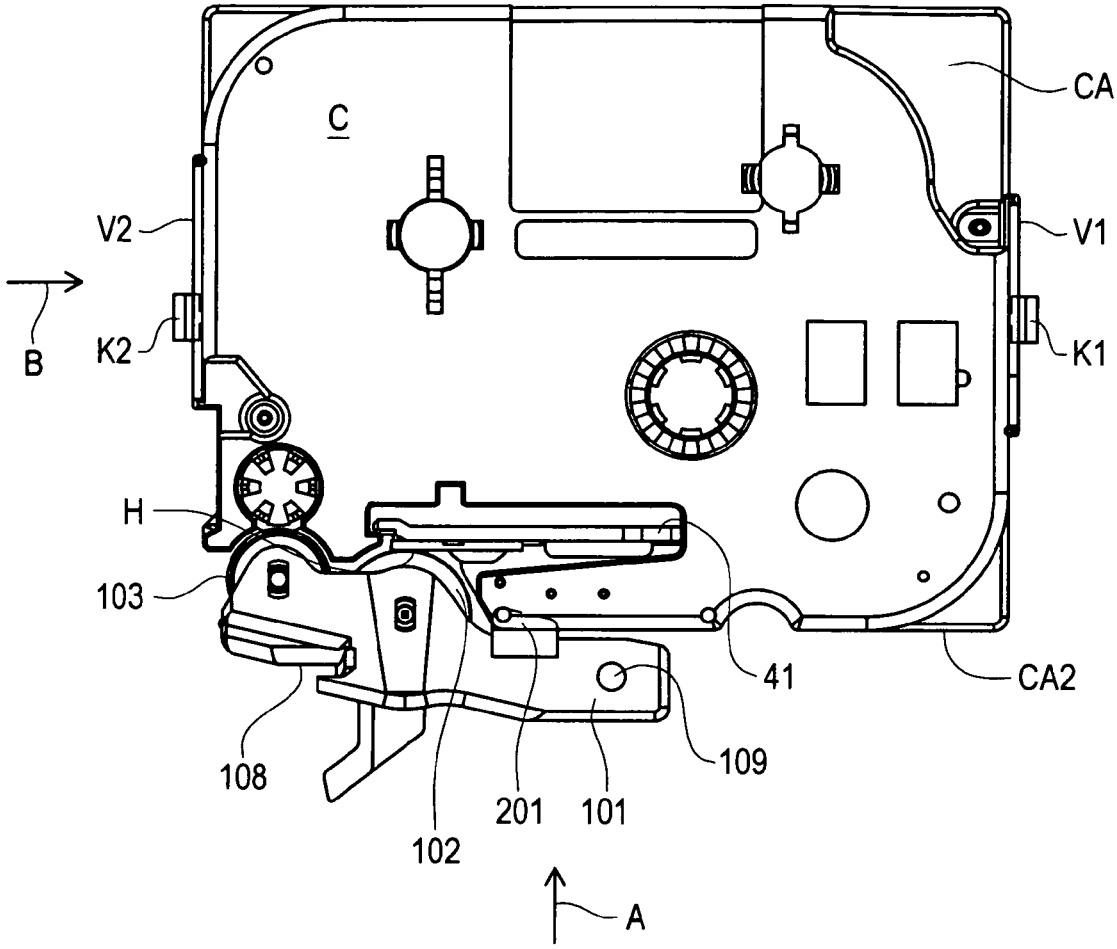
FIG. 20 is a plan view showing the positioning relationship between the projection of the roller holder and a cassette when a user attempts to load the cassette inside the cassette loading portion, in a case wherein the platen roller has adhered to the thermal head of the tape printer.
Figure 21:
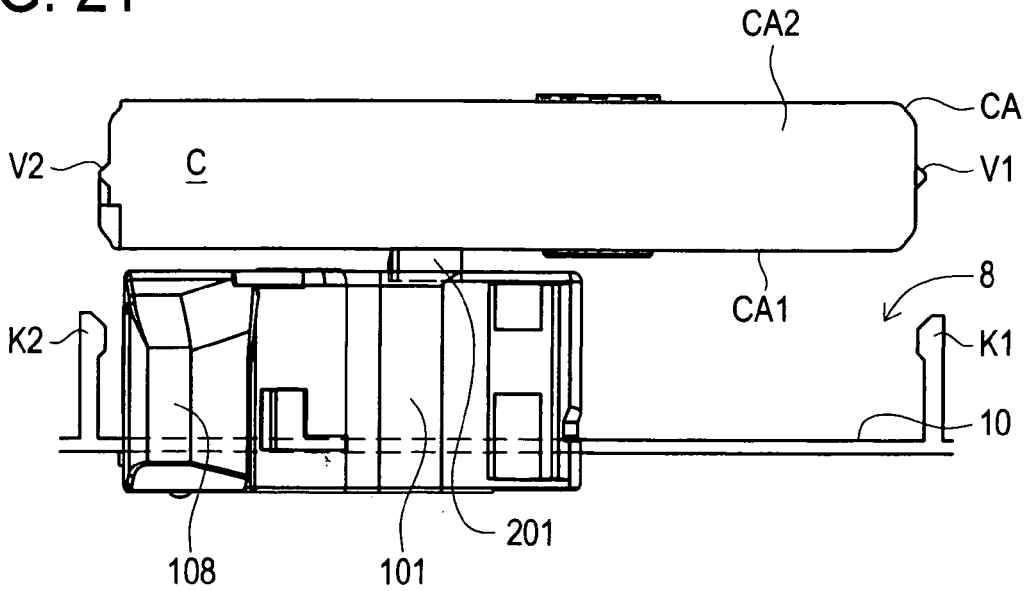
FIG. 21 is a view showing the positioning relationship between the projection of the roller holder and a cassette when a user attempts to load the cassette inside the cassette loading portion, in a case wherein the platen roller has adhered to the thermal head of the tape printer, and is a side view taken along arrow A in FIG. 20.
Figure 22:
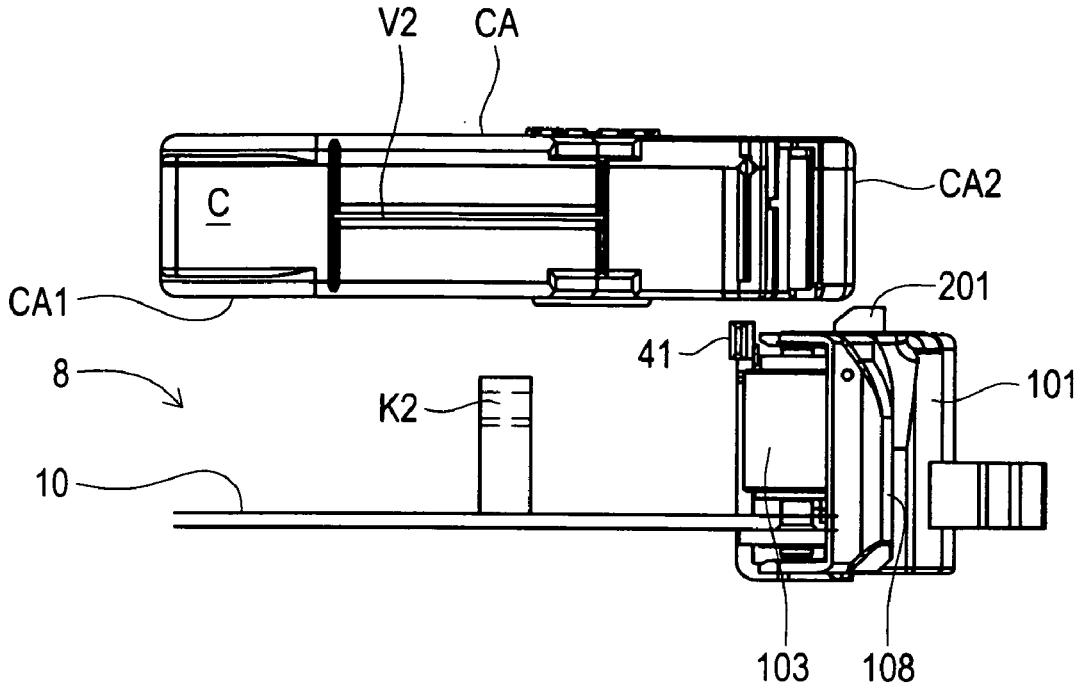
FIG. 22 is a view showing the positioning relationship between the projection of the roller holder and a cassette when a user attempts to load the cassette inside the cassette loading portion, in a case wherein the platen roller has adhered to the thermal head of the tape printer, and is a side view taken along arrow B in FIG. 20.

In the tape printer 1 according to the first embodiment, if a user attempts to load the cassette C inside the cassette loading portion 8, in a case wherein the platen roller 102 has adhered to the thermal head H (refer to FIG. 17 through FIG. 19), the positioning relationship between the cassette C and the projection 201 of the roller holder 101 is as shown in FIG. 20 through FIG. 22.

Figure 1:
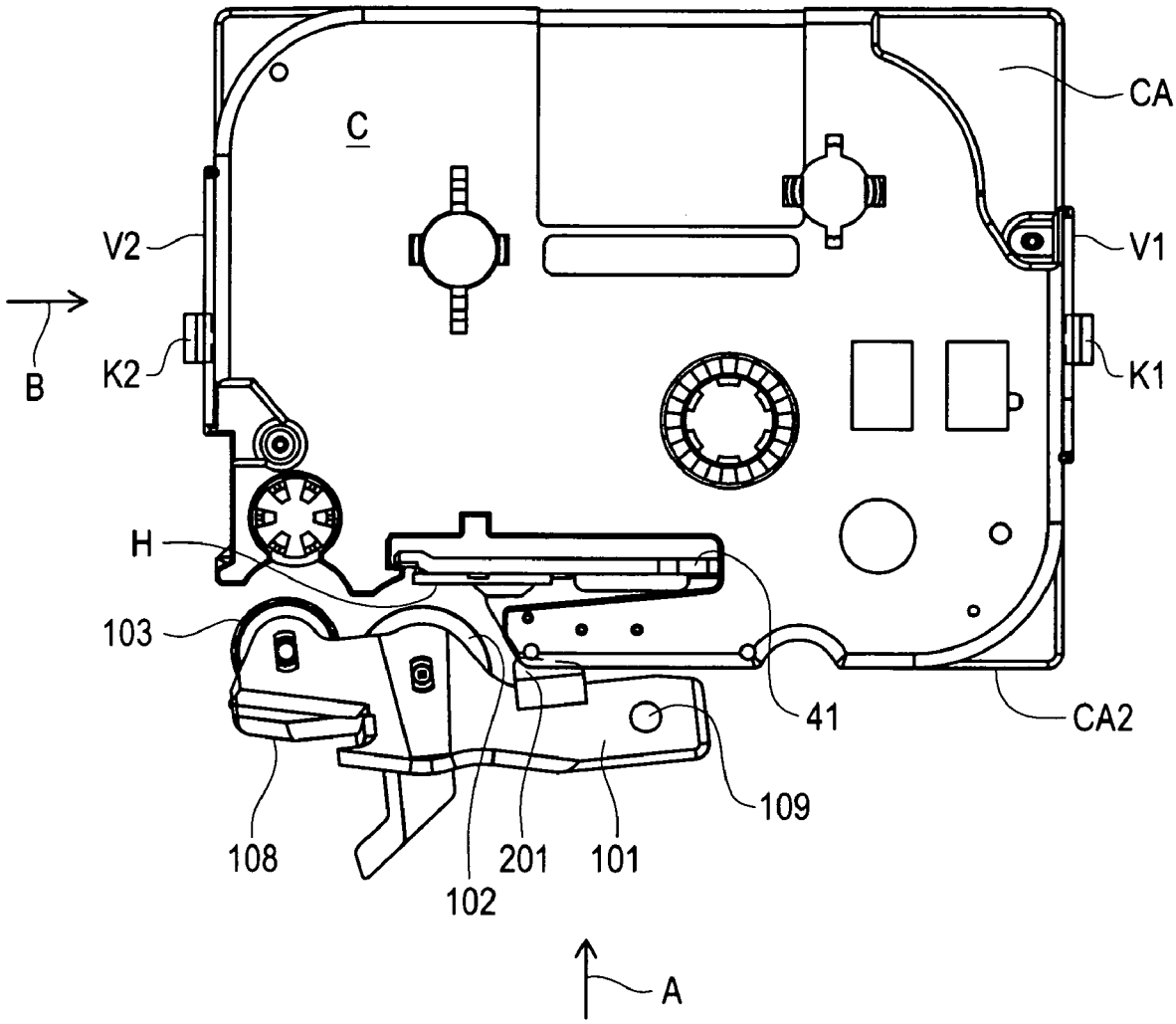
FIG. 1 is a plan view showing the relationship when a cassette abuts against a projection of a roller holder at the time a user attempts to load the cassette inside a cassette loading portion, in a case wherein a platen roller has adhered to a thermal head of a tape printer according to a first embodiment.
Figure 23:
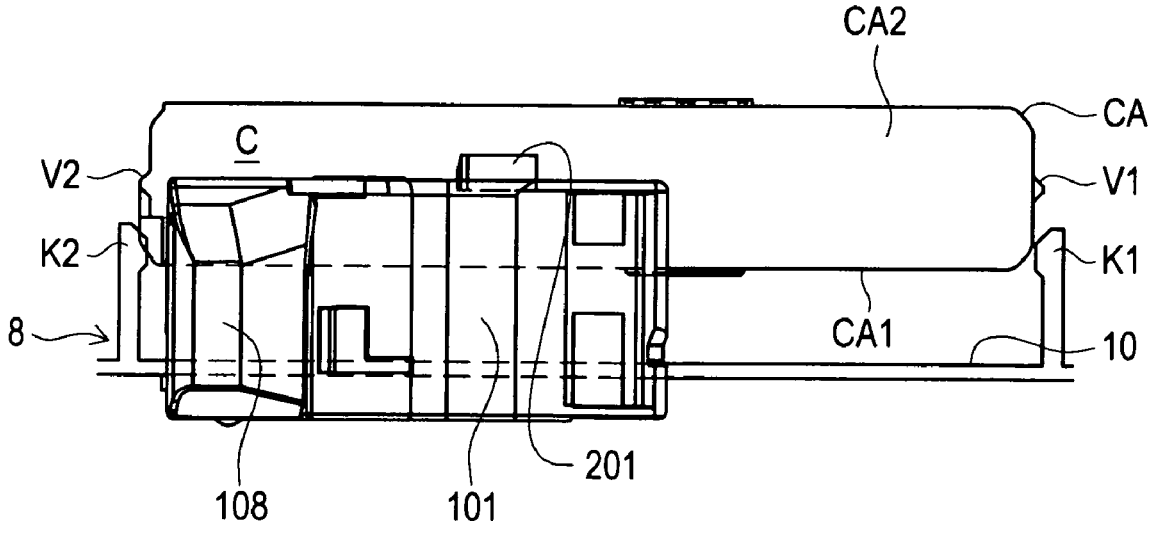
FIG. 23 is a view showing the relationship when a cassette abuts against the projection of the roller holder at the time a user attempts to load the cassette inside the cassette loading portion, in a case wherein the platen roller has adhered to the thermal head of the tape printer, and is a side view taken along arrow A in FIG. 1.
Figure 24:
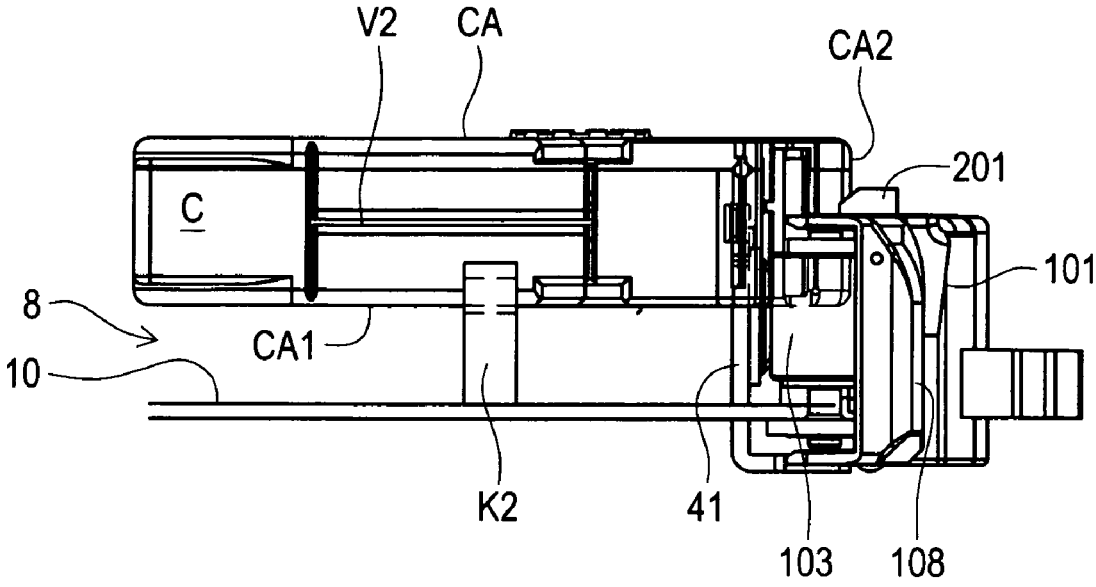
FIG. 24 is a view showing the relationship when a cassette abuts against the projection of the roller holder at the time a user attempts to load the cassette inside the cassette loading portion, in a case wherein the platen roller has adhered to the thermal head of the tape printer, and is a side view taken along arrow B in FIG. 1.
Figure 25:
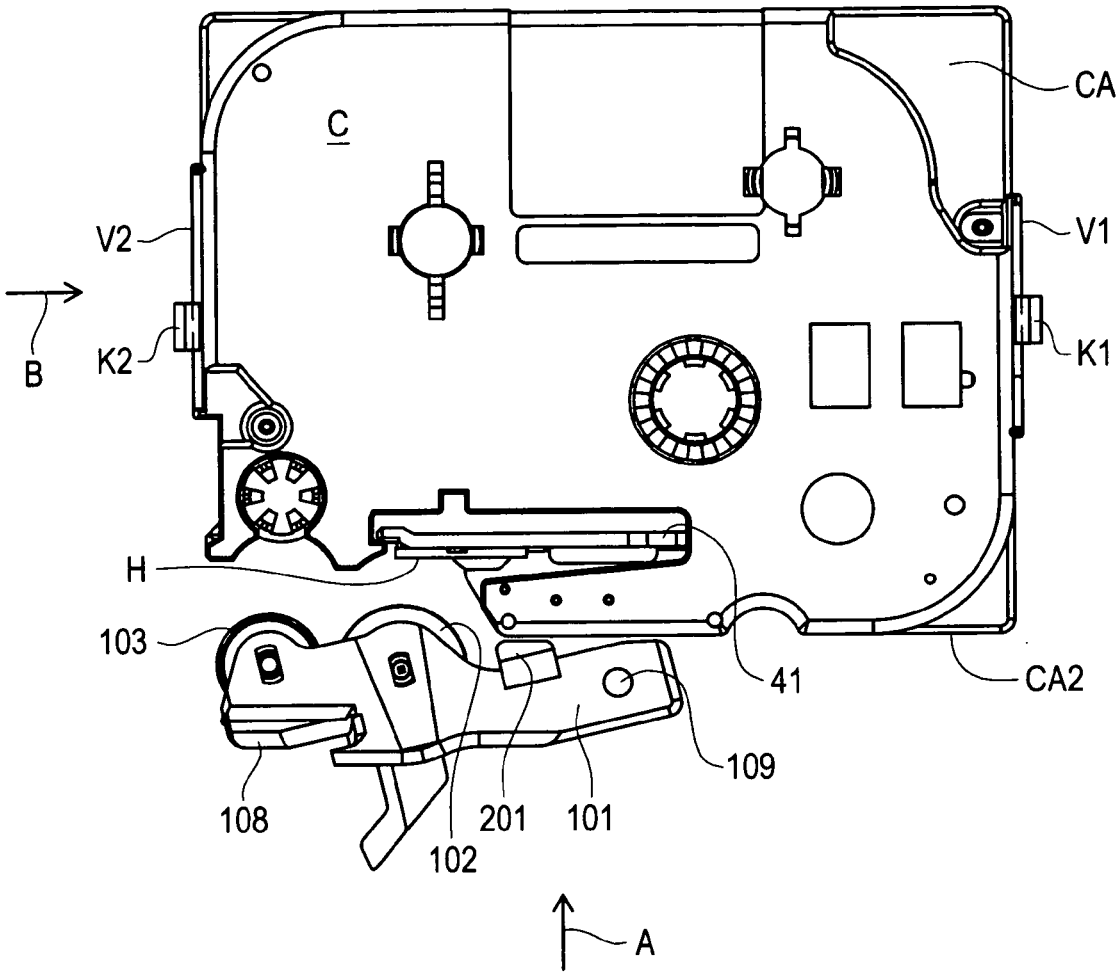
FIG. 25 is a plan view showing the positioning relationship between the projection of the roller holder and a cassette when the cassette is accurately set inside the cassette loading portion of the tape printer.
Figure 26:
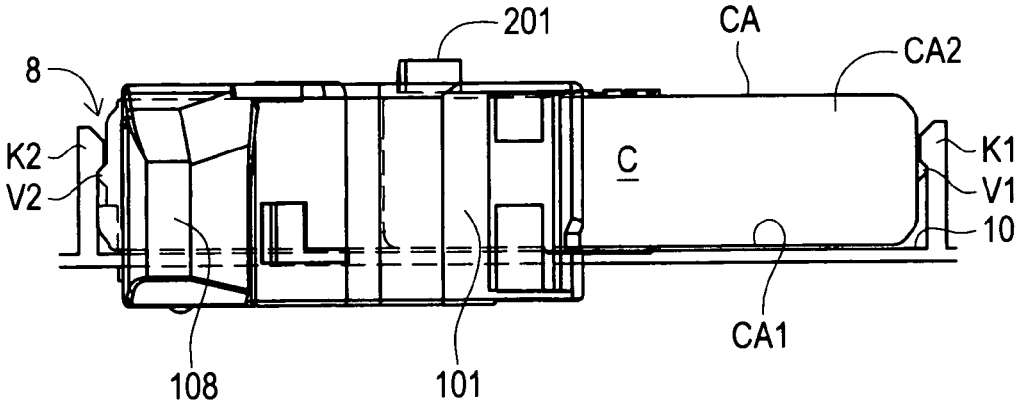
FIG. 26 is a view showing the positioning relationship between the projection of the roller holder and a cassette when the cassette is accurately set inside the cassette loading portion of the tape printer, and is a side view taken along arrow A in FIG. 25.
Figure 27:
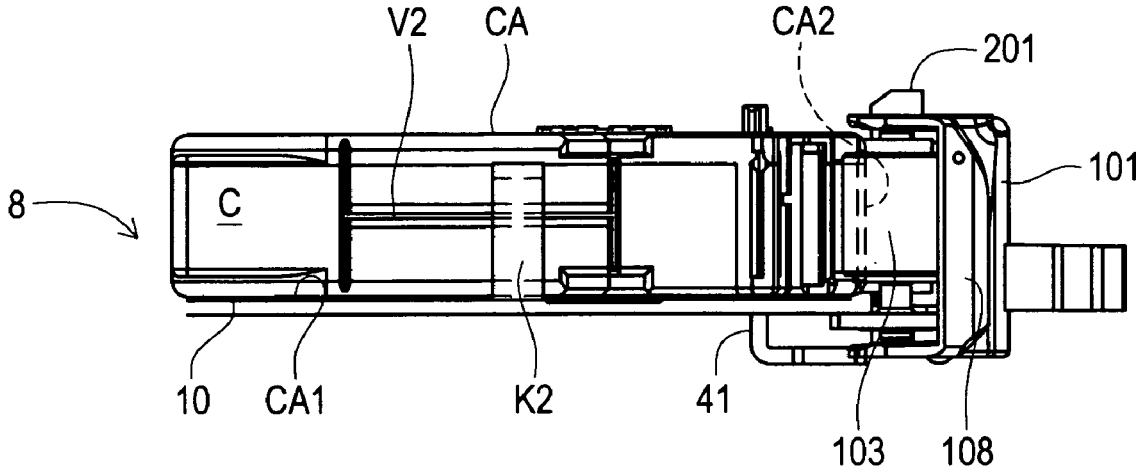
FIG. 27 is a view showing the positioning relationship between the projection of the roller holder and a cassette when the cassette is accurately set inside the cassette loading portion of the tape printer, and is a side view taken along arrow B in FIG. 25.

When a user attempts to accurately set the cassette C inside the cassette loading portion 8, the bottom wall CA1 and the front side wall CA2 of the cassette C will abut against the projection 201 of the roller holder 101. At this time, the cassette C is moved by the user in the direction of the cassette loading portion 8. Accordingly, as shown in FIG. 1, FIG. 23 and FIG. 24, during the time the bottom wall CA1 and the front side wall CA2 of the cassette C abut against the projection 201 of the roller holder 101, the cassette C pushes the projection 201 of the roller holder 101. Thus, a force acts on the roller holder 101 causing it to rotate counterclockwise on the drawing in FIG. 1, around the rotating shaft 109. This allows the platen roller 102 to be separated from the thermal head H. As a result, the roller holder 101 is rotated in a biasing direction (direction from inward to outward of the cassette loading portion 8).

Thereafter, when rotation of the roller holder 101 in a biasing direction (direction from inward to outward of the cassette loading portion 8) is stopped, a state is maintained wherein the roller holder 101 is disengaged from the supporting board 41. As a result, the cassette C can be accurately set inside the cassette loading portion 8.

Figure 28:
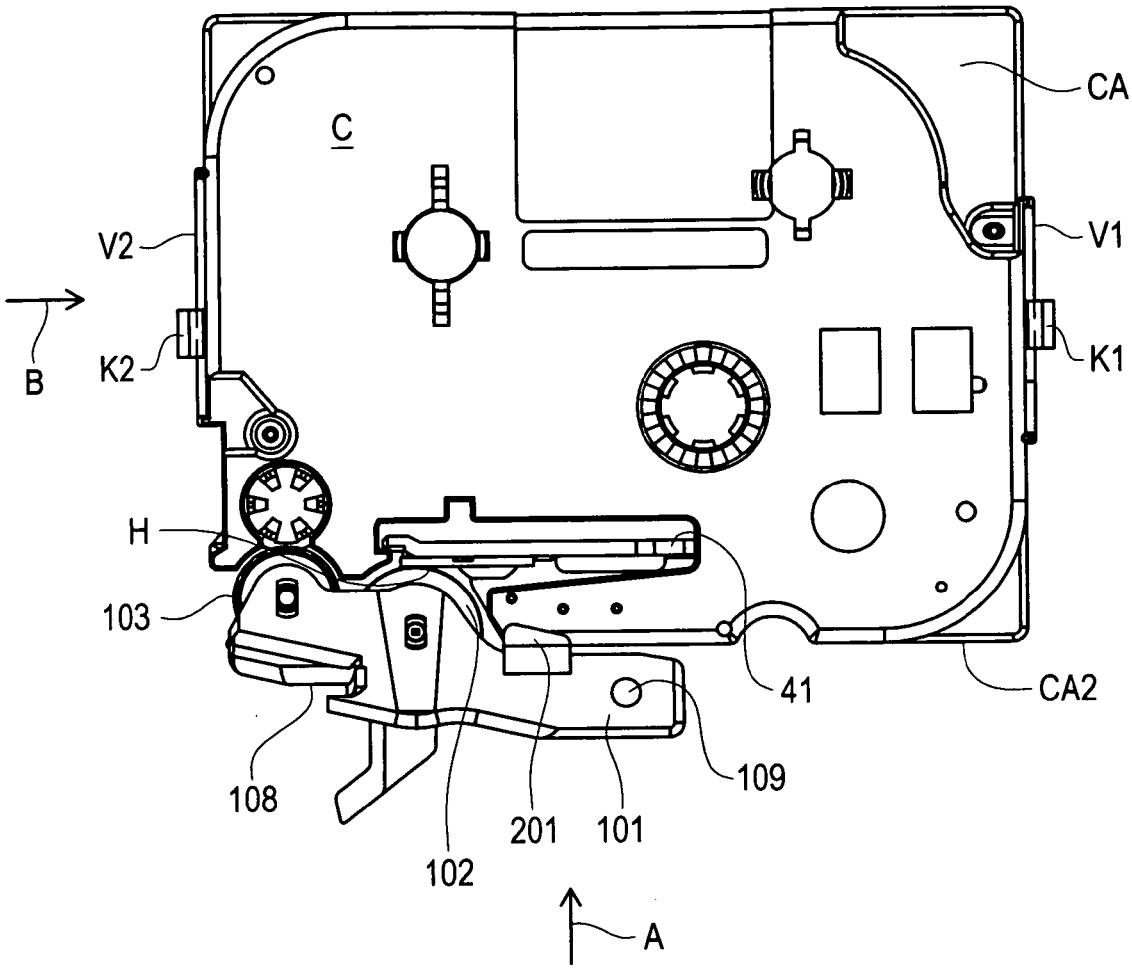
FIG. 28 is a plan view showing the positioning relationship between the projection of the roller holder and a cassette when the roller holder is pressed against a supporting board, after the cassette has been accurately set inside the cassette loading portion of the tape printer.
Figure 29:
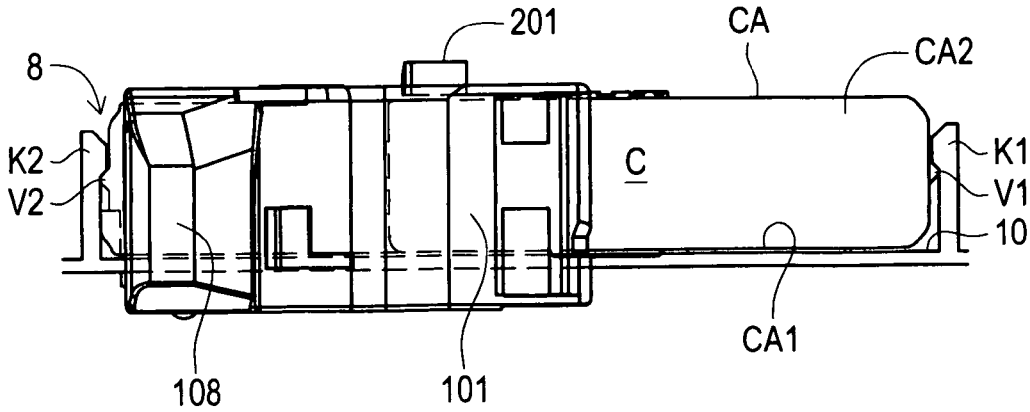
FIG. 29 is a view showing the positioning relationship between the projection of the roller holder and a cassette when the roller holder is pressed against the supporting board, after the cassette has been accurately set inside the cassette loading portion of the tape printer, and is a side view taken along arrow A in FIG. 28.
Figure 30:
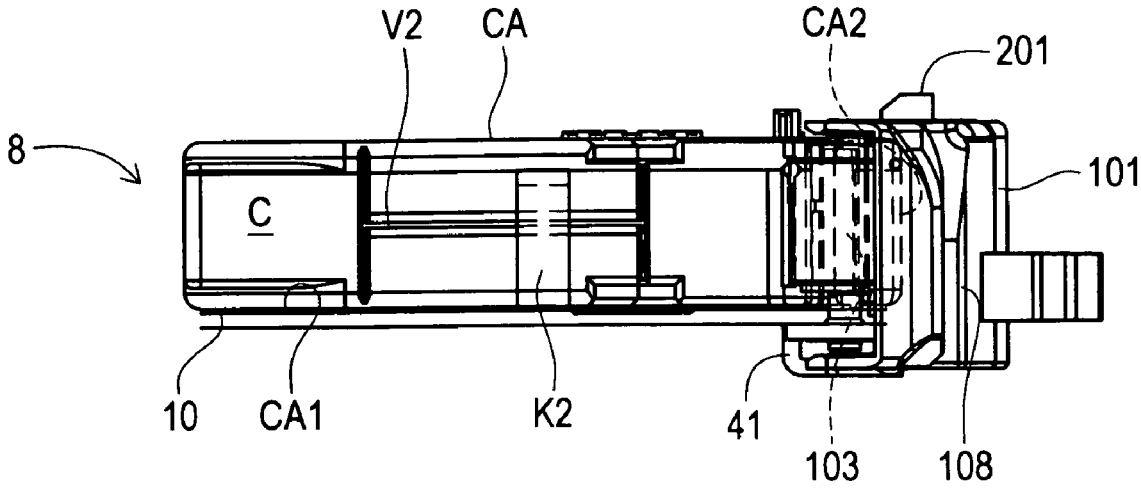
FIG. 30 is a view showing the positioning relationship between the projection of the roller holder and a cassette when the roller holder is pressed against the supporting board, after the cassette has been accurately set inside the cassette loading portion of the tape printer, and is a side view taken along arrow B in FIG. 28.

When the cover 11 is attached to the main body 2 as was descried earlier, after the cassette C has been accurately set inside the cassette loading portion 8, the roller holder 101 rotates in an anti-biasing direction (direction from outward to inward of the cassette loading portion 8). At this time, the projection 201 of the roller holder 101 moves on the cassette case CA (under the cover 11) of the cassette C. Accordingly, the roller holder 101 is pressed against the supporting board 41, as shown in FIG. 28 through FIG. 30, without being hindered by the projection 201 of the roller holder 101.

Alternatively, if the cassette C is not accurately set inside the cassette loading portion 8, when a user attempts to rotate the roller holder 101 in an anti-biasing direction (direction from outward to inward of the cassette loading portion 8) by attempting to attach the cover 11 to the main body 2, the projection 201 of the roller holder 101 abuts against the front side wall CA of the cassette C, as shown in FIG. 31 through FIG. 33. As a result, the roller holder 101 cannot be pressed against the supporting board 41.

4. Summary

As was described earlier in detail, in the first embodiment, the projection 201 is provided in the roller holder 101 of the tape printer 1. Accordingly, in a state wherein the roller holder 101 is pressed against the supporting board 41 to make the platen roller 102 come in close contact with the thermal head H, the cassette C presses the roller holder 101 through the projection 201 in a process of loading the cassette C inside the cassette loading portion 8 (for instance, refer to FIG. 1, and FIG. 17 through FIG. 27). As a result, the roller holder 101 moves in a biasing direction (direction from inward to outward of the cassette loading portion 8), causing the roller holder 101 to move away from the supporting board 41. Thus, even if a state is maintained wherein the platen roller 102 adhered to the thermal head H and the roller holder 101 is kept pressed against the supporting board 41, the roller holder 101 can be separated from the supporting board 41 when the cassette C is loaded up.

The surface of the projection 201 facing the cover 11 which is attached to the main body 2 is formed as a slanted surface extending and being slanted from the base to the tip thereof. Thus, the slanted surface of the projection 201 abuts against the bottom wall CA1 and the front side wall CA2 of the cassette C in a process of loading the cassette C inside the cassette loading portion 8 (for instance, refer to FIG. 1 and FIG. 17 through FIG. 27). Accordingly, a pressing force can be caused to effectively act from the cassette C in a biasing direction (biasing direction from inward to outward of the cassette loading portion 8) with respect to the roller holder 101 which is kept pressed against the supporting board 41 by the platen roller 102 having adhered to the thermal head H.

Alternatively, if the cassette C is not accurately set inside the cassette loading portion 8 of the tape printer 1, the roller holder 101 is caused to rotate in an anti-biasing direction (direction from outward to inward of the cassette loading portion 8) by attaching the cover 11 to the main body 2. As a result, the roller holder 101 which was caused to rotate in an anti-basing direction (direction from outward to inward of the cassette loading portion 8) abuts against the front side wall CA of the cassette C through the projection 201, as shown in FIG. 31 through FIG. 33. Accordingly, the rotation of the roller holder 101 in an anti-biasing direction (direction from outward to inward of the cassette loading portion 8) is restrained midways, making it impossible to press the roller holder 101 against the supporting board 41. Thus, even if tape printing is started in the state as described above, jamming of the tape-like film TF of the cassette C will not occur inside the cassette loading portion 8.

If the cassette C is accurately set inside the cassette loading portion 8, the projection 201 of the roller holder 101 is projected on the cassette case CA (and under the cover 11) of the cassette C, when the platen roller 102 is in close contact with the thermal head H, as shown in FIG. 11 through FIG. 13 and FIG. 28 through FIG. 30. Further, as is shown in the drawings, considering the cassette loading portion 8 and the cassette C are approximately the same size, the projection 201 of the roller holder 101 when the platen roller 102 is in close contact with the thermal head H is projected inside a loading trajectory at the time the cassette C is loaded in the cassette loading portion 8. Accordingly, when the cassette C has been loaded inside the cassette loading portion 8, the cassette C will necessarily abut against the projection 201 of the roller holder 101 which is being pressed against the supporting board 41, specifically, the roller holder 101 which supports the platen roller 102 which adhered to the thermal head H, around a shaft.

In the first embodiment, although the projection 201 is provided on the roller holder 101 of the tape printer 1, this will not hinder the printing operation in the tape printer 1. This is because, when the cassette C is accurately set inside the cassette loading portion 8 of the tape printer 1, the cassette C will receive no interference through the projection 201, as shown in FIG. 11 through FIG. 13 and FIG. 28 through FIG. 30. Thus, the roller holder 101 can move in an anti-biasing direction (direction from outward to inward of the cassette loading portion 8), pressing against the supporting board 41. Accordingly, the roller holder 101 can be separated from the supporting board 41 even if the cassette C is used in tape printers which are used in general.

The tape printer 1 according to the first embodiment has the pair of engaging portions K1 and K2 which are provided in the cassette loading portion 8. Once the cassette C inside the cassette loading portion 8 is engaged with the pair of engaging portions K1 and K2, the cassette C is secured inside the cassette loading portion 8 in an accurate setting position, as shown in FIG. 8 through FIG. 13 and FIG. 25 through FIG. 30.

Accordingly, when the cassette C has been placed in the cassette lading portion 8, if a user engages the cassette C with the pair of engaging portions K1 and K2, the cassette C will always be secured inside the cassette loading portion 8 in the accurate setting position. However, this mechanism requires passing through a state wherein the pair of liner protruding portions V1 and V2 of the cassette C are placed with respect to the pair of engaging portions K1 and K2. If the tape printer 1 is left in the state, specifically, a state wherein the cassette C is not engaged with the pair of engaging portions K1 and K2 as shown in FIG. 31 through FIG. 33, for instance, the tape printer 1 is kept in a state wherein the cassette C is not accurately set inside the cassette loading portion 8. As a result, an environment is created wherein jamming of the tape-like film TF is likely to occur in the cassette C, which increases the need for a mechanism to carry out the operations as described in the first embodiment.

In the tape printer 1 according to the first embodiment, the cover 11 is detachable from the main body 2. Thus, the cover 11 can be removed from the main body 2 when the cassette loading portion 8 is open. Accordingly, as the cover 11 can be freely moved, the cover 11 may be attached to the main body 2 by sheer force when the cassette loading portion 8 is covered with the cover 11 by attaching the cover 11 to the main body 2, even if the cassette C which is placed in the cassette loading portion 8 is not accurately set therein. Thus, an environment is created wherein jamming of the tape-like film TF is likely to occur inside the cassette C, which increases the need for a mechanism to carry out the operations as described in the first embodiment.

5. Second Embodiment

In the first embodiment, the projection 201 is provided in the roller holder 101 of the tape printer 1. However, a structure corresponding to the projection 201 may also be provided in the cassette C side, as is shown in the second embodiment as will be described later.

Figure 40:
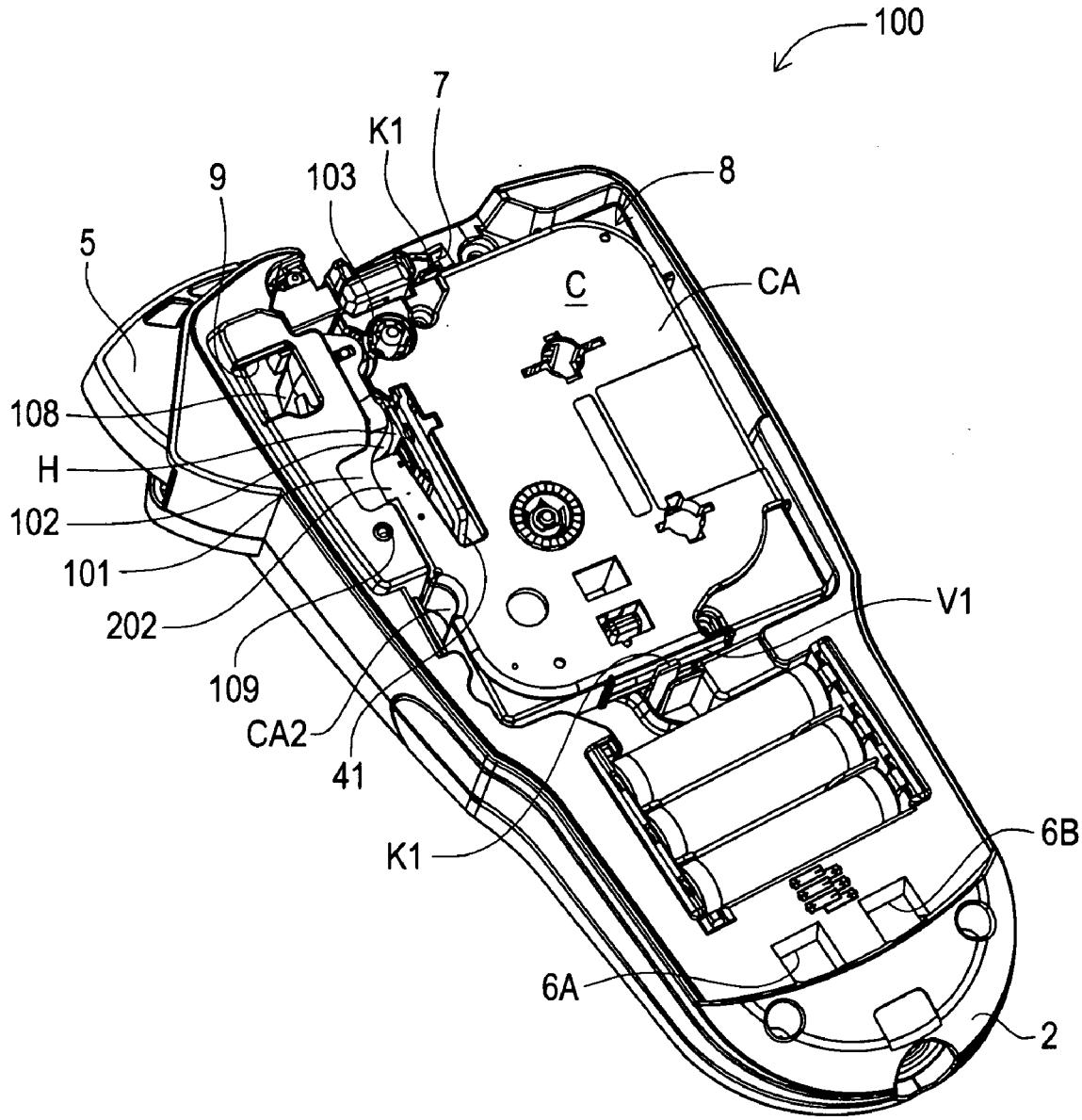
FIG. 40 is a perspective view showing an outer appearance of the tape printer in which the platen roller is pressed against the thermal head when the cassette is loaded, as seen from a back side of the tape printer.
Figure 41:
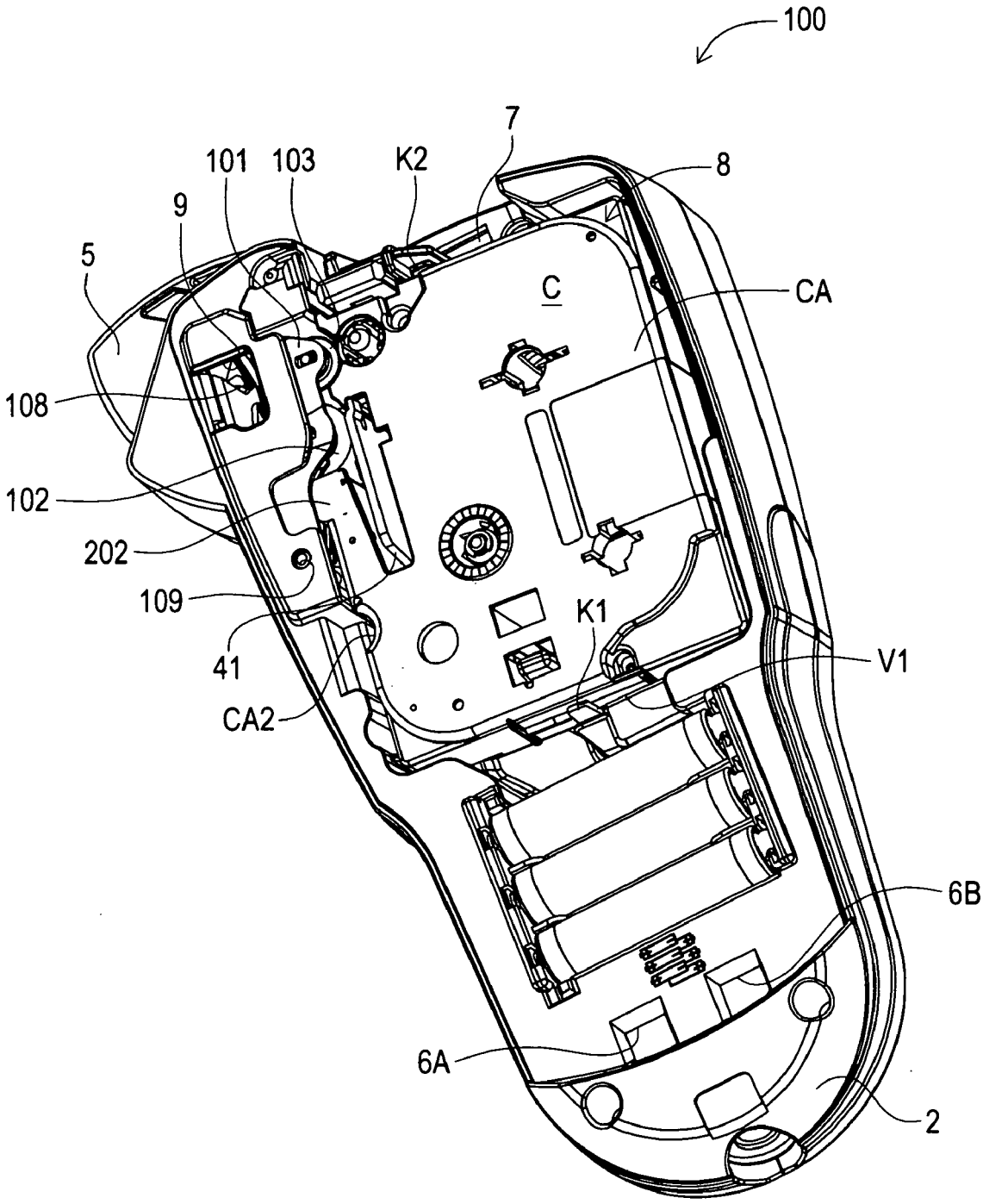
FIG. 41 is a perspective view showing an outer appearance of the tape printer in which the platen roller is pressed against the thermal head when the cassette is loaded, as seen from a back side of the tape printer.
Figure 42:
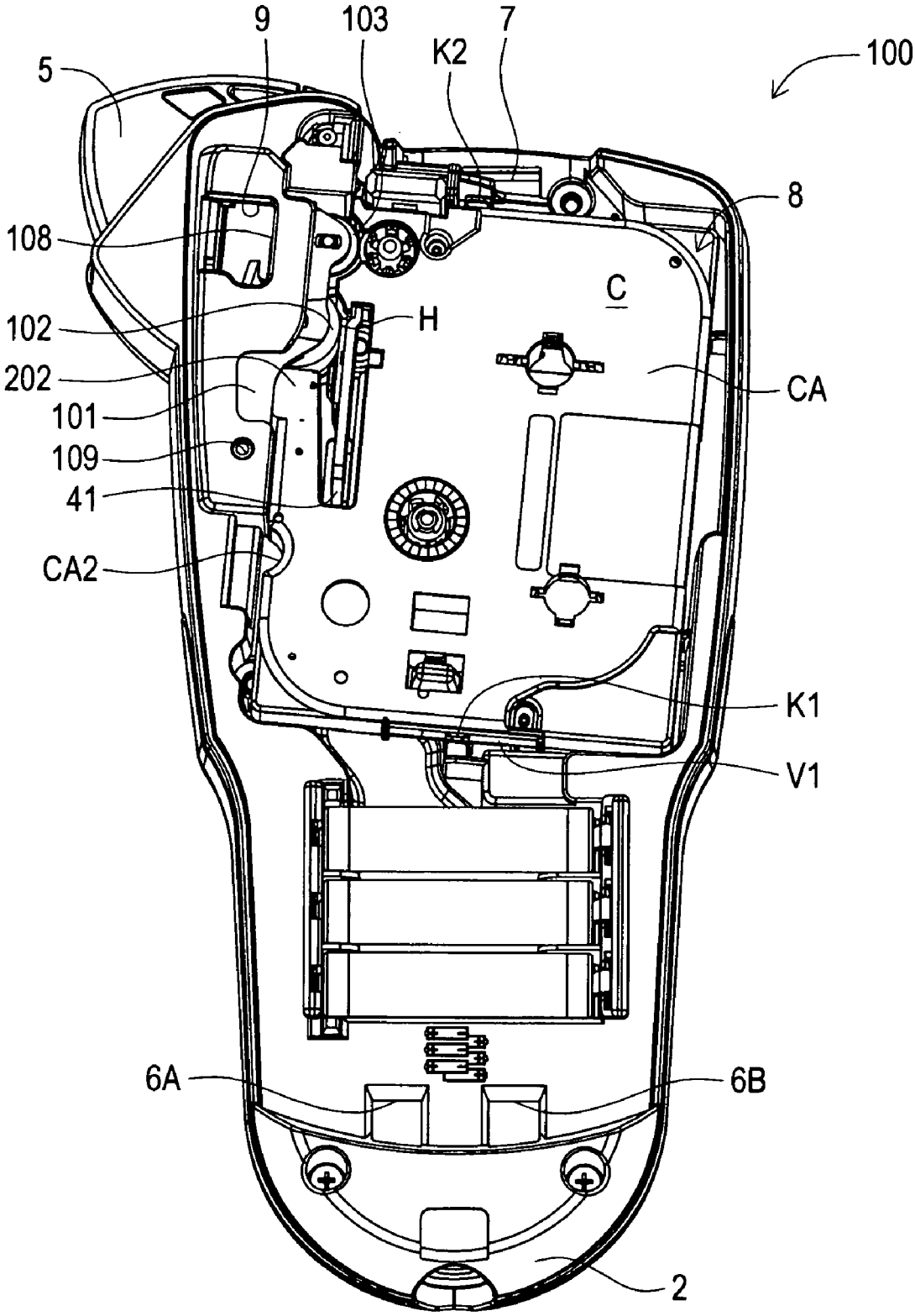
FIG. 42 is a perspective view showing an outer appearance of the tape printer in which the platen roller is pressed against the thermal head when the cassette is loaded, as seen from a back side of the tape printer.
Figure 43:
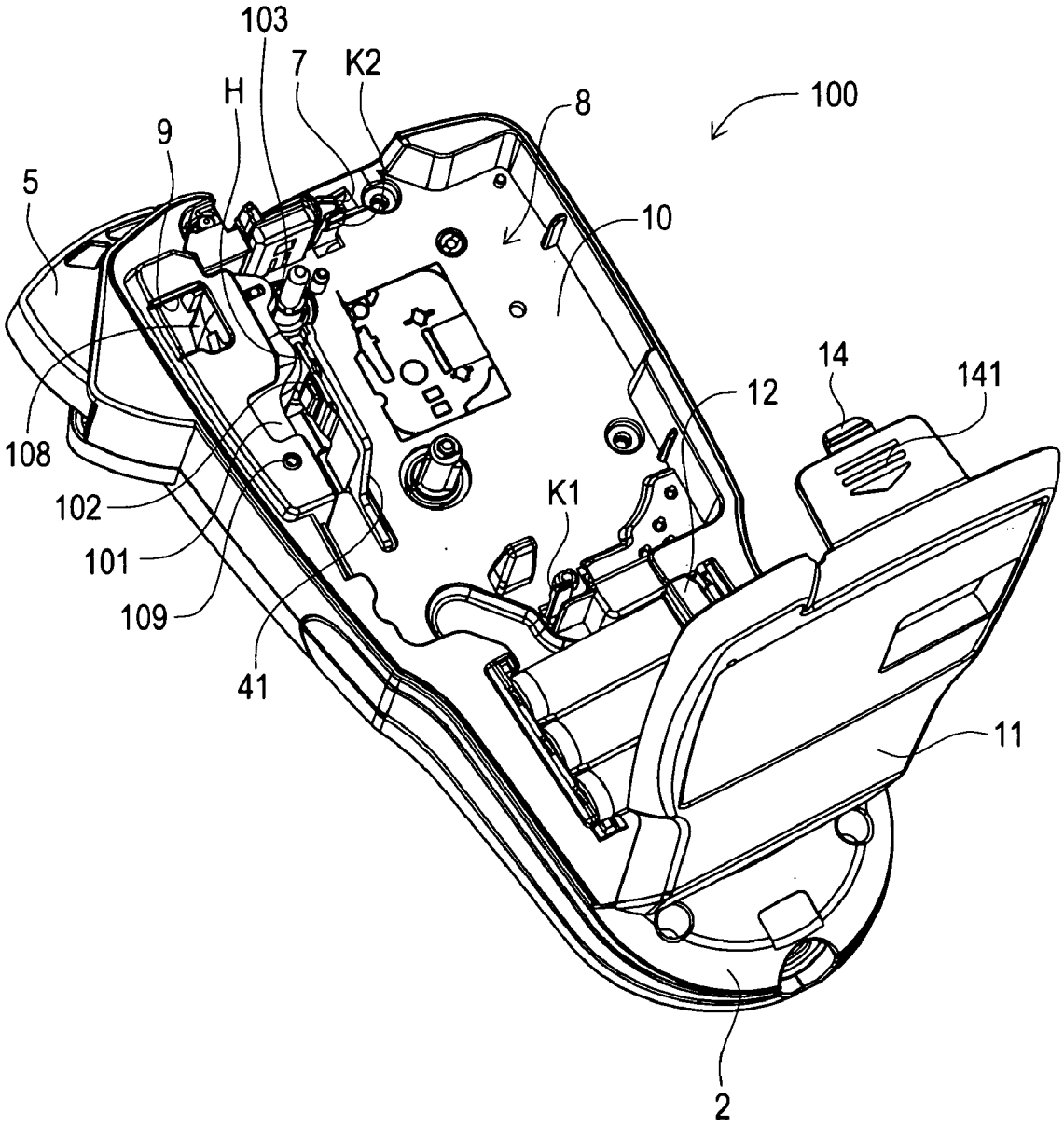
FIG. 43 is a perspective view showing an outer appearance of the tape printer in which the cover is open and the platen roller which adhered to the thermal head is exposed, in a case wherein the cassette is not loaded in a cassette loading portion, as seen from a back side of the tape printer.
Figure 44:
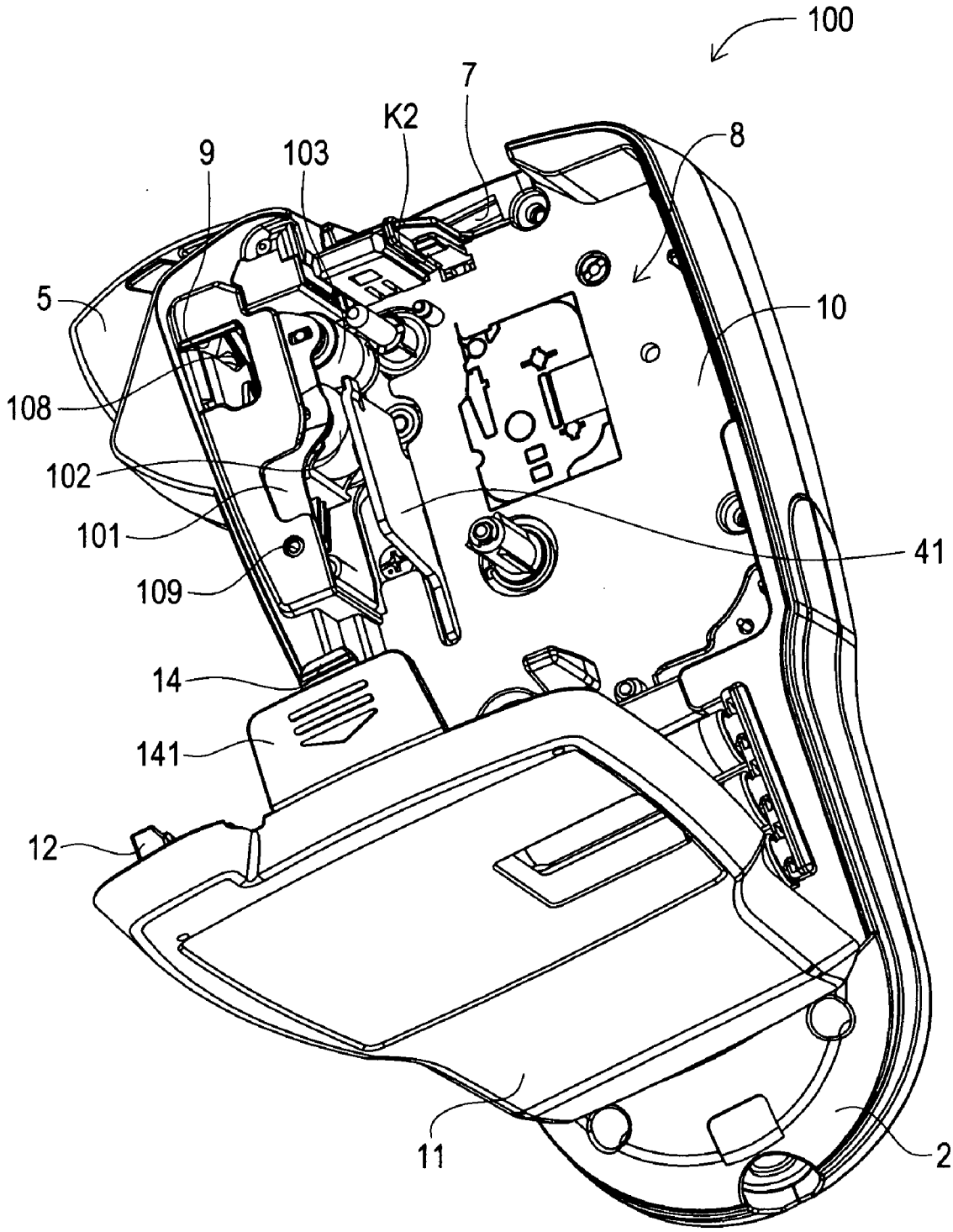
FIG. 44 is a perspective view showing an outer appearance of the tape printer in which the cover is open and the platen roller which adhered to the thermal head is exposed, in a case wherein the cassette is not loaded in the cassette loading portion, as seen from a back side of the tape printer.
Figure 45:
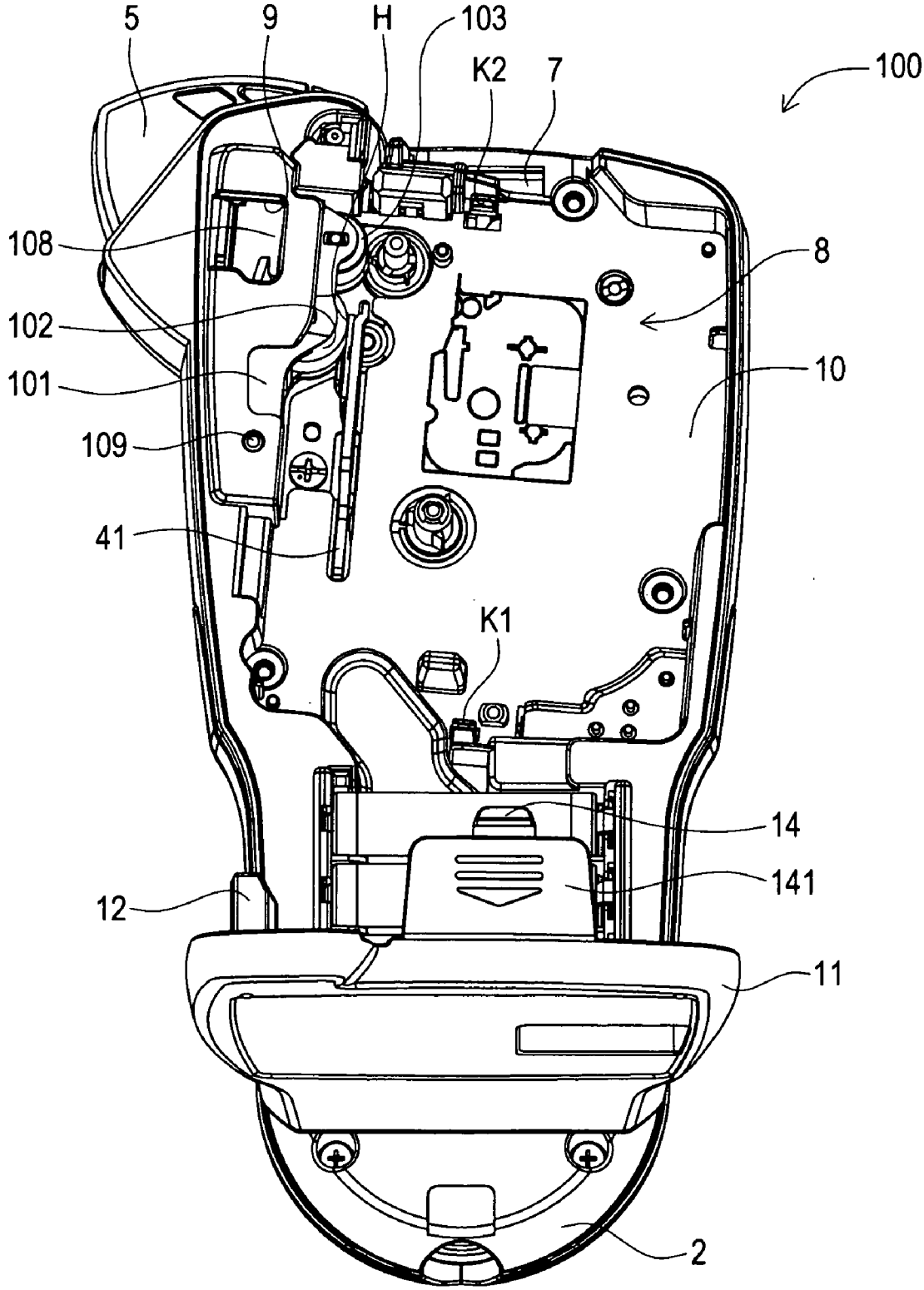
FIG. 45 is a perspective view showing an outer appearance of the tape printer in which the cover is open and the platen roller which adhered to the thermal head is exposed, in a case wherein the cassette is not loaded in the cassette loading portion, as seen from a back side of the tape printer.
Figure 46:
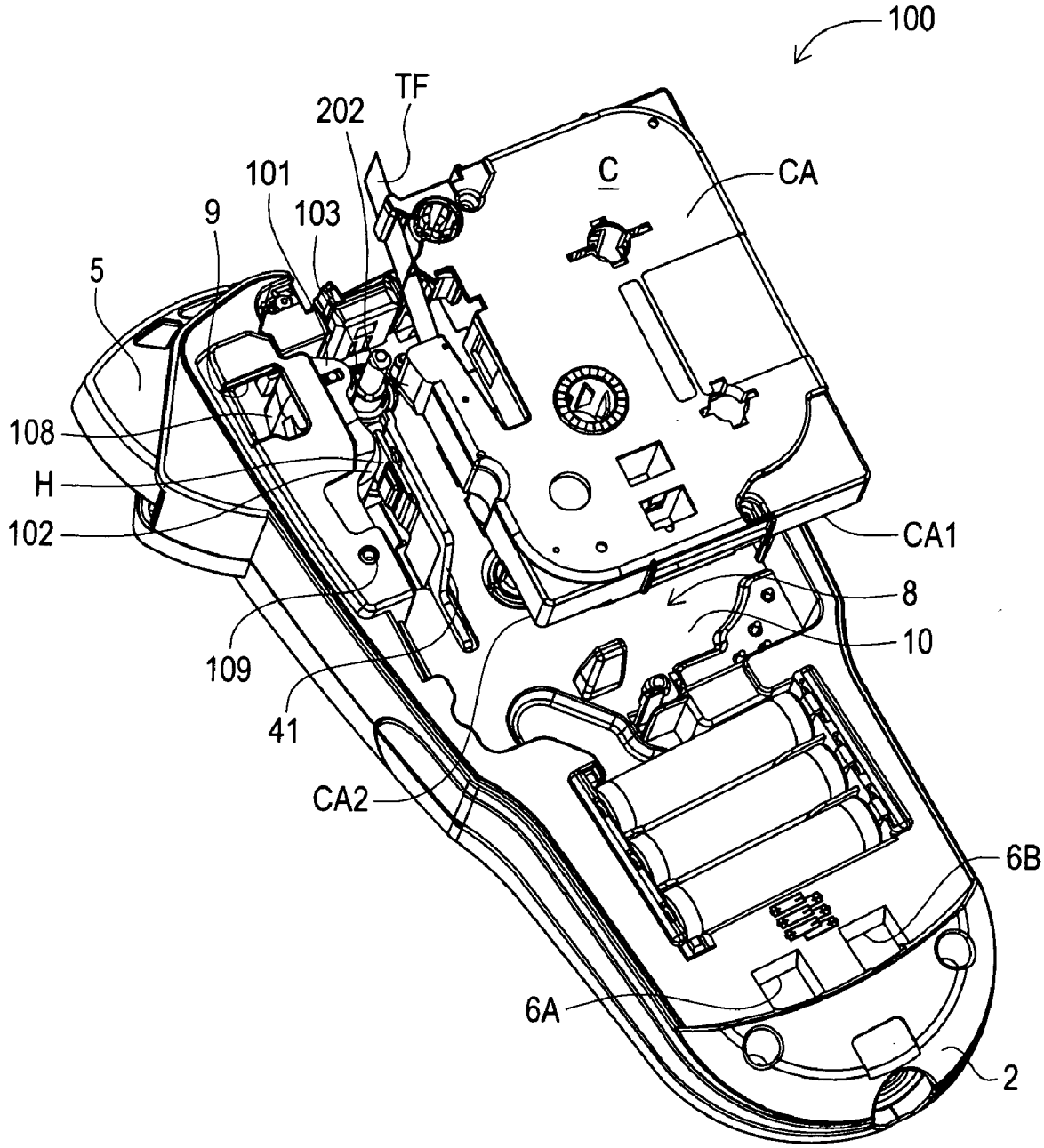
FIG. 46 is a perspective view showing an outer appearance of the tape printer in which the cassette is loaded inside the cassette loading portion when the cover is removed under a condition wherein the platen roller adhered to the thermal head, as seen from a back side of the tape printer.
Figure 47:
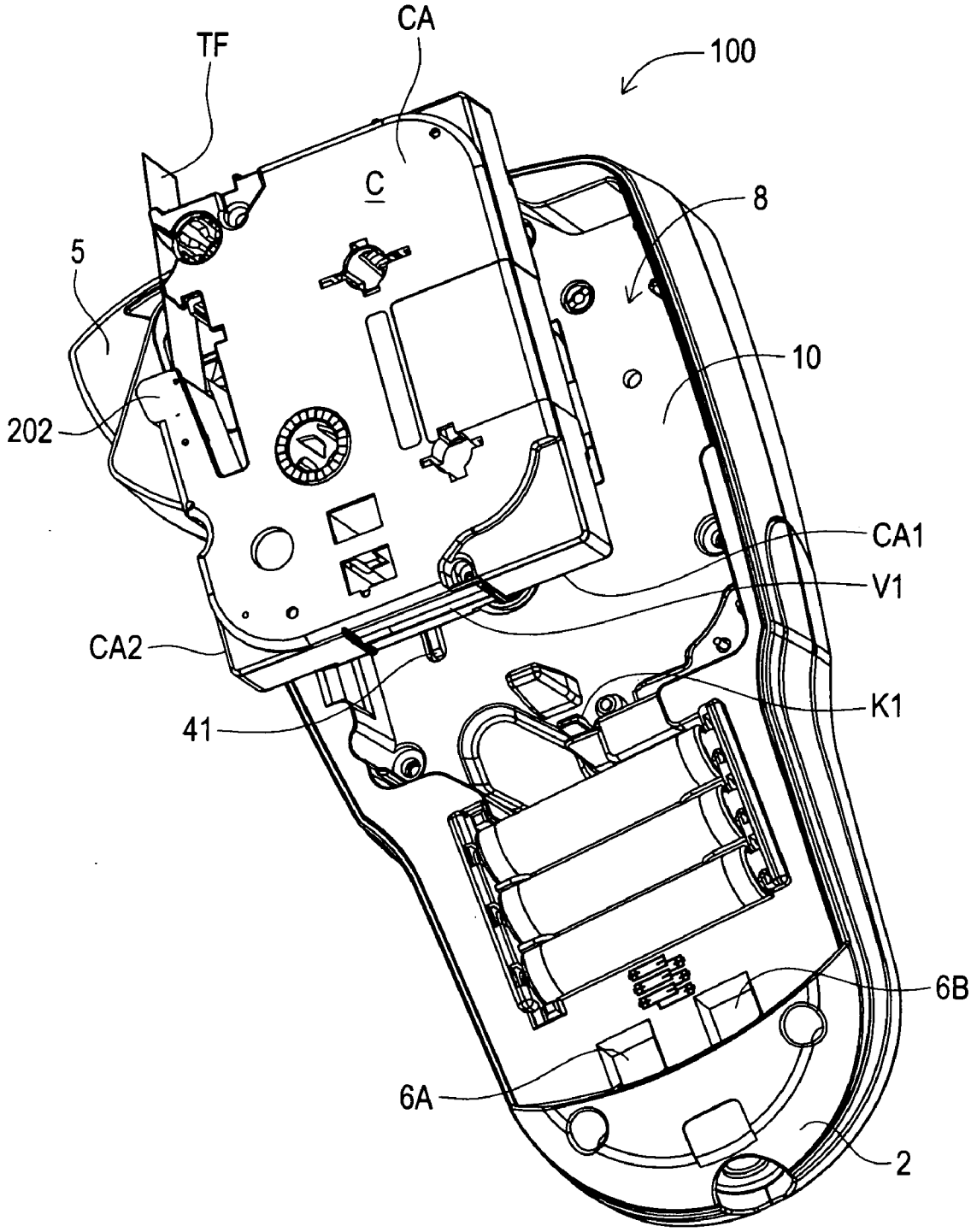
FIG. 47 is a perspective view showing an outer appearance of the tape printer in which the cassette is loaded inside the cassette loading portion when the cover is removed under a condition wherein the platen roller adhered to the thermal head, as seen from a back side of the tape printer.
Figure 48:
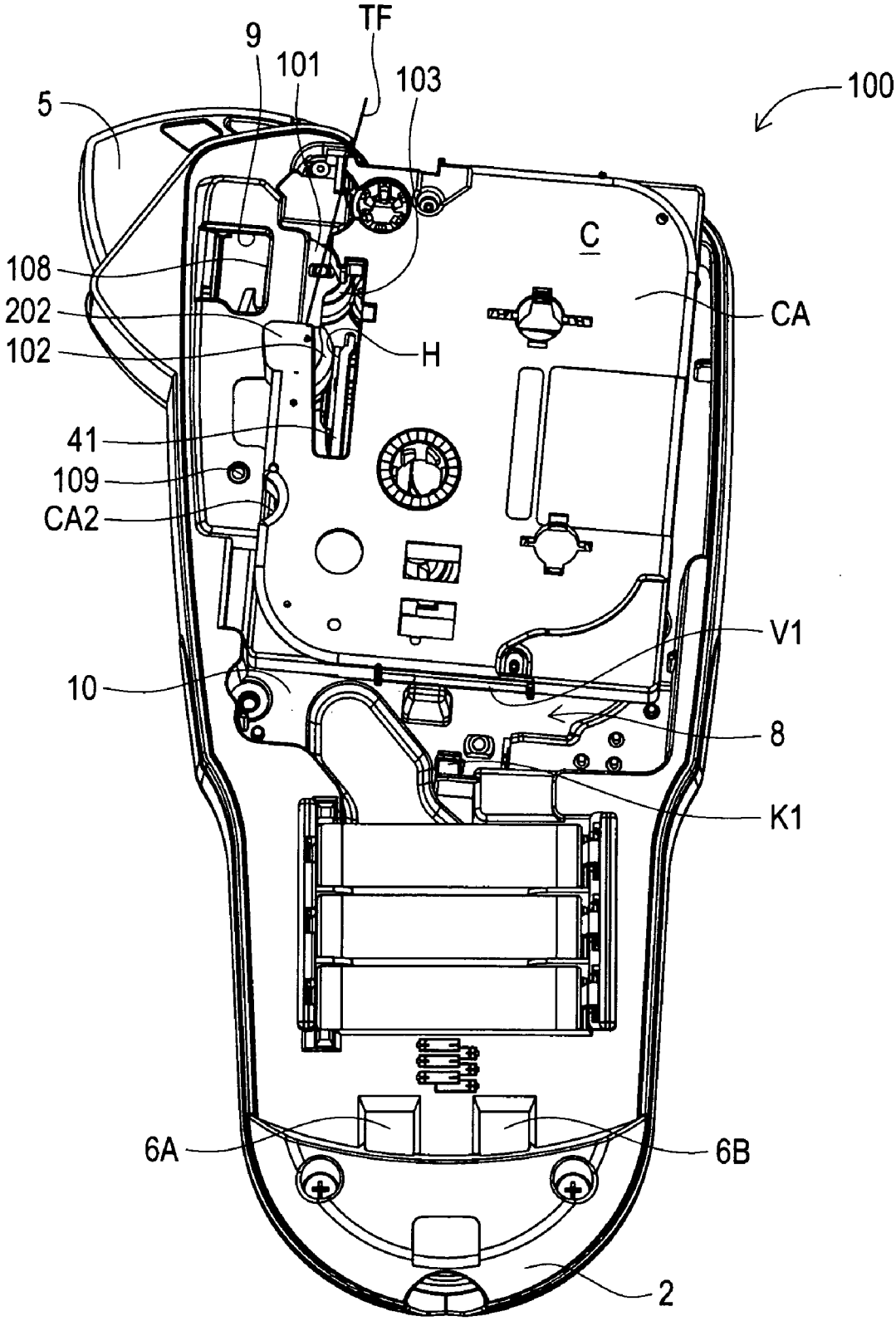
FIG. 48 is a perspective view showing an outer appearance of the tape printer in which the cassette is loaded inside the cassette loading portion when the cover is removed under a condition wherein the platen roller adhered to the thermal head, as seen from a back side of the tape printer.

FIG. 40 through FIG. 42 show a state wherein the platen roller 102 is pressed against the thermal head H with the tape-like film of the cassette C being held thereinbetween, by attaching the cover 11 to the main body 2, when the cassette C has been accurately set inside the cassette loading portion 8. FIG. 40 through FIG. 42 show the state that the platen roller 102 is pressed against the thermal head H and therefore, the tape-like film of the cassette C and the cover 11 are omitted from the drawings.

The tape printer 100 shown in FIG. 34 through FIG. 48 differs from the tape printer 1 according to the first embodiment. The differences include the fact that the projection 201 according to the first embodiment is not provided in the roller holder 101. The rest of the configuration is the same as that of the tape printer 1 according to the first embodiment. Thus, the same numerical symbols as those in the first embodiment are used herein as well, and further detailed description of the tape printer 100 will hereby be omitted.

Contrary to this, the cassette C has a projection 202 which is provided at a contact portion between the bottom wall CA1 and the front side wall CA2 of the cassette case CA. The projection 202 is projected toward the roller holder 101 when the cassette C is accurately set inside the cassette loading portion 8. The projection 202 has a slanted surface which fades further in the distance from the roller holder 101 towards the bottom wall CA1, when the cassette C is accurately set inside the cassette loading portion 8. This projection 202 has the same function as the projection 201 of the first embodiment.

Specifically, in the second embodiment, the projection 202 is provided in the cassette C. Accordingly, in a state wherein the roller holder 101 is pressed against the supporting board 41 to make the platen roller 102 come in close contact with the thermal head H, the cassette C presses the roller holder 101 through the projection 202 in a process of loading the cassette C inside the cassette loading portion 8 (for instance, refer to FIG. 34 through FIG. 40). As a result, the roller holder 101 moves in a biasing direction (direction from inward to outward of the cassette loading portion 8), causing the roller holder 101 to move away from the supporting board 41. Thus, even if a state is maintained wherein the platen roller 102 adhered to the thermal head H and the roller holder 101 is kept pressed against the supporting board 41, the roller holder 101 can be separated from the supporting board 41 when the cassette C is loaded up.

The projection 202 has a slanted surface which fades further in the distance from the roller holder 101 towards the bottom wall CA1, when the cassette C is accurately set inside the cassette loading portion 8. Thus, the slanted surface of the projection 202 abuts against the roller holder 101 in a process of loading the cassette C inside the cassette loading portion 8 (for instance, refer to FIG. 34 through FIG. 40). Accordingly, a pressing force can be caused to effectively act from the cassette C in a biasing direction (biasing direction from inward to outward of the cassette loading portion 8) with respect to the roller holder 101 which is kept pressed against the supporting board 41 by the platen roller 102 having adhered to the thermal head H.

Alternatively, if the cassette C is not accurately set inside the cassette loading portion 8 of the tape printer 100, the roller holder 101 is caused to rotate in an anti-biasing direction (direction from outward to inward of the cassette loading portion 8) by attaching the cover 11 to the main body 2. As a result, the roller holder 101 which was caused to rotate in an anti-biasing direction (direction from outward to inward of the cassette loading portion 8) abuts against the projection 202 of the cassette C. Accordingly, the rotation of the roller holder 101 in an anti-biasing direction (direction from outward to inward of the cassette loading portion 8) is restrained midways, making it impossible to press the roller holder 101 against the supporting board 41. Thus, even if tape printing is started in the state as described above, jamming of the tape-like film TF of the cassette C will not occur inside the cassette loading portion 8.

If the cassette C is accurately set inside the cassette loading portion 8, the projection 202 provided in the cassette C is projected inward of the roller holder 101, when the platen roller 102 is in close contact with the thermal head H, as shown in FIG. 40 through FIG. 42. Further, as is shown in the drawings, considering the cassette loading portion 8 and the cassette C are approximately the same size, the roller holder 101 when the platen roller 102 is in close contact with the thermal head H is projected inside a loading trajectory of the projection 202 at the time the cassette C is loaded in the cassette loading portion 8. Accordingly, when the cassette C has been loaded inside the cassette loading portion 8, the projection 202 of the cassette C will necessarily abut against the roller holder 101 which is pressed against the supporting board 41.

In the second embodiment, although the projection 202 is provided in the cassette C, this will not hinder the printing operation in the tape printer 100. This is because, when the cassette C is accurately set inside the cassette loading portion 8 of the tape printer 100, the cassette C will receive no interference through the projection portion 202, as shown in FIG. 40 through FIG. 42. Thus, the roller holder 101 can move in an anti-biasing direction (direction from outward to inward of the cassette loading portion 8), pressing against the supporting board 41. Accordingly, the roller holder 101 can be separated from the supporting board 41 even if the cassette C is used in tape printers which are used in general.

In the second embodiment, the tape printer 100 has the pair of engaging portions K1 and K2 which are provided in the cassette loading portion 8. Once the cassette C inside the cassette loading portion 8 is engaged with the pair of engaging portions K1 and K2, the cassette C is secured inside the cassette loading portion 8 in an accurate setting position, as shown in FIG. 37 through FIG. 42.

Accordingly, when the cassette C has been placed in the cassette lading portion 8, if a user engages the cassette C with the pair of engaging portions K1 and K2, the cassette C will always be secured inside the cassette loading portion 8 in the accurate setting position. However, this mechanism requires passing through a state wherein the pair of liner protruding portions V1 and V2 of the cassette C are placed with respect to the pair of engaging portions K1 and K2. If the tape printer 100 is left in the state, specifically, a state wherein the cassette C is not engaged with the pair of engaging portions K1 and K2, the tape printer 100 is kept in a state wherein the cassette C is not accurately set inside the cassette loading portion 8. As a result, an environment is created wherein jamming of the tape-like film TF is likely to occur in the cassette C, which increases the need for a mechanism to carry out the operations as described in the second embodiment.

In the tape printer 100 according to the second embodiment, the cover 11 is detachable from the main body 2. Thus, the cover 11 can be removed from the main body 2 when the cassette loading portion 8 is open. Accordingly, as the cover 11 can be freely moved, the cover 11 may be attached to the main body 2 by sheer force when the cassette loading portion 8 is covered with the cover 11 by attaching the cover 11 to the main body 2, even if the cassette C which is placed in the cassette loading portion 8 is not accurately set therein. Thus, an environment is created wherein jamming of the tape-like film TF is likely to occur inside the cassette C, which increases the need for a mechanism to carry out the operations as described in the second embodiment.

6. Other

The present disclosure is not limited to the above-described embodiments, but various modifications can be made thereto without departing from the spirit of the present disclosure. For instance, in the first and second embodiments, movement of the roller holder 101 in an anti-biasing direction (direction from outward to inward of the cassette loading portion 8) may not be caused to work in conjunction with movement of the projection 12 provided in the cover 11. For instance, a dedicated lever can be provided to carry out movement in an anti-biasing direction (direction from outward to inward of the cassette loading portion 8) of the roller holder 101.

In the first and second embodiments, the supporting board having the thermal head H provided therein may be used in place of the roller holder 101 having the platen roller 102 provided therein. In this case, the supporting board is rotatably supported on the main body 2 while being biased from inward to outward of the cassette loading portion 8. Accordingly, by attaching the cover 11 to the main body 2, the supporting board moves in an anti-biasing direction (direction from outward to inward of the cassette loading portion 8) in conjunction with movement of the projection 12 which is provided in the cover 11 when the cassette loading portion 8 is covered with the cover 11.

While the presently exemplary embodiment has been shown and described, it is to be understood that this disclosure is for the purpose of illustration and that various changes and modification may be made with departing from the scope of the disclosure as set in the appended claims.

What is claimed is:

1. A tape printer including: a main body; a cassette loading portion provided in the main body; a pressing member that is rotatably supported on the main body while being biased from inward to outward of the cassette loading portion; and a supporting member provided in the cassette loading portion; the pressing member and supporting member being in close contact with each other, wherein the pressing member is pressed against the supporting member by causing the supporting member to move in an anti-biasing direction; the tape printer further comprising:

a projection provided in the pressing member;

wherein the pressing member is moved in a biasing direction to be moved away from the supporting member as a result of a cassette pressing the projection provided in the pressing member against the pressing member and the supporting member in a process of loading the cassette inside the cassette loading portion.

2. The tape printer of claim 1, wherein the projection of the pressing member which is brought in close contact with the supporting member is projected inside a loading trajectory at the time of loading the cassette inside the cassette loading portion.

3. The tape printer of claim 1, wherein the projection has a slanted surface shape.

4. The tape printer of claim 1, wherein the pressing member moves in an anti-biasing direction and is pressed against the supporting member without interfering with the cassette, when the cassette is accurately loaded inside the cassette loading portion.

5. The tape printer of claim 4, further comprising:

a pair of engaging portions provided in the cassette loading portion;

wherein once the cassette inside the cassette loading portion is engaged with the pair of engaging portions, the cassette is secured inside the cassette loading portion in an accurate setting position.

6. The tape printer of claim 1, further comprising:

a cover that covers/opens the cassette loading portion;

wherein the pressing member is pressed against the supporting member by causing the pressing member to move in an anti-biasing direction in a case wherein the cassette loading portion is covered by the cover.

7. The tape printer of claim 6, further comprising:

a protruding portion provided in the cover;

wherein when the cassette loading portion is covered by the cover, the pressing member moves in an anti-biasing direction in conjunction with movement of the protruding portion.

8. The tape printer of claim 6, wherein the cover is detachable with respect to the main body.

9. The tape printer of claim 1, wherein the supporting member is a printing head.

10. The tape printer of claim 1, wherein the pressing member is a platen holding member.

11. A cassette for use in a tape printer, the tape printer including: a main body; a cassette loading portion provided in the main body; a pressing member that is rotatably supported on the main body while being biased from inward to outward of the cassette loading portion; and a supporting member provided in the cassette loading portion, the pressing member and supporting member being in close contact with each other; wherein the pressing member is pressed against the supporting member by causing the pressing member to move in an anti-biasing direction; wherein when set in the cassette loading portion of the main body, the cassette includes:

a bottom wall that faces a bottom face of the cassette loading portion;

a side wall that is continued from the bottom wall and faces the pressing member; and a cassette case that has a projection which is provided at a contact portion between the bottom wall and the side wall and extends towards the pressing member;

wherein the pressing member is moved in a biasing direction to be moved away from the supporting member as a result of the projection in the cassette pressing the pressing member against the pressing member and the supporting member in a process of loading the cassette inside the cassette loading portion.

12. The cassette of claim 11, wherein the pressing member which is brought in close contact with the supporting member is positioned inside a trajectory of the projection at the time of loading the cassette inside the cassette loading portion.

13. The cassette of claim 11, wherein the projection has a slanted surface shape.

14. The cassette of claim 11, wherein the pressing member moves in an anti-biasing direction and is pressed against the supporting member without interfering with the projection, when the cassette is accurately loaded inside the cassette loading portion.

15. The cassette of claim 14, wherein the cassette is secured inside the cassette loading portion in an accurate setting position once the cassette is engaged with a pair of engaging portions which are provided inside the cassette loading portion.

16. The cassette of claim 11, wherein the cassette is used in the tape printer wherein the pressing member is pressed against the supporting member by causing the pressing member to move in an anti-biasing direction in a case wherein the cassette loading portion is covered with a cover that covers/opens the cassette loading portion.

17. The cassette of claim 16, wherein the cassette is used in the tape printer wherein the pressing member is moved in an anti-biasing direction in conjunction with movement of a protruding portion provided in the cover, in a ease wherein the cassette loading portion is covered with the cover.

18. The cassette of claim 16, wherein the cassette is used in the tape printer wherein the cover is detachable with respect to the main body.

19. The cassette of claim 11, wherein the cassette is used in the tape printer wherein the supporting member is a printing head.

20. The cassette of claim 11, wherein the cassette is used in the tape printer wherein the pressing member is a platen holding member.

* * * * *